US010378702B2

(12) United States Patent
Sharrah et al.

(10) Patent No.: US 10,378,702 B2
(45) Date of Patent: Aug. 13, 2019

(54) PORTABLE LIGHT WITH PLANE OF A LASER LIGHT

(71) Applicant: STREAMLIGHT, INC., Eagleville, PA (US)

(72) Inventors: Raymond L. Sharrah, Collegeville, PA (US); Thomas D. Boris, Collegeville, PA (US); Donald J. Keeley, Emmaus, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 15/492,344

(22) Filed: Apr. 20, 2017

(65) Prior Publication Data

US 2017/0307148 A1 Oct. 26, 2017

Related U.S. Application Data

(60) Provisional application No. 62/325,917, filed on Apr. 21, 2016.

(51) Int. Cl.

| | |
|---|---|
| ***F21L 4/02*** | (2006.01) |
| ***F21V 5/04*** | (2006.01) |
| ***F21V 23/04*** | (2006.01) |
| ***F21V 14/02*** | (2006.01) |
| ***F21L 4/04*** | (2006.01) |
| *F21Y 115/30* | (2016.01) |

(52) U.S. Cl.

CPC ..... *F21L 4/025* (2013.01); *F21L 4/045* (2013.01); *F21V 5/043* (2013.01); *F21V 14/025* (2013.01); *F21V 23/0414* (2013.01); *F21Y 2115/30* (2016.08)

(58) Field of Classification Search

CPC ..... F21L 4/025; F21L 4/045; F21V 5/043; F21V 14/025; F21V 23/0414

See application file for complete search history.

(56) References Cited

U.S. PATENT DOCUMENTS

| | | | |
|---|---|---|---|
| 6,031,649 | A | 2/2000 | Cotty et al. |
| 6,150,943 | A | 11/2000 | Lehman et al. |
| 6,724,467 | B1 | 4/2004 | Billmers et al. |

(Continued)

OTHER PUBLICATIONS

Sean & Stephen Corporation,(untitled), date prior to Apr. 20, 2017, 1 page.

(Continued)

*Primary Examiner* — Anh T Mai
*Assistant Examiner* — Nathaniel J Lee
(74) *Attorney, Agent, or Firm* — Clement A. Berard, Esq.; Dann, Dorfman, Herrell & Skillman, PC

(57) ABSTRACT

A portable light may comprise: a light body having an illumination, e.g., white, light source and a laser light source supported thereby, each source being selectively energizable for producing light; and a switch for selectively energizing the illumination light source and/or laser light source. The laser light source is configured to provide a plane of laser light, so as to create a line of laser light on objects illuminated by the plane of laser light. The laser light source may include a cylindrical lens to create the plane of laser light. The plane of laser light may be rotatable relative to the light body. A TIR optical element may also be disposed in front of the illumination light source for receiving the light produced thereby.

31 Claims, 14 Drawing Sheets

(56) References Cited

U.S. PATENT DOCUMENTS

| | | | | |
|---|---|---|---|---|
| 6,864,799 | B2 * | 3/2005 | Popps | G08B 7/062 340/321 |
| 7,114,861 | B1 * | 10/2006 | Tung | G02B 7/026 385/92 |
| 7,188,978 | B2 | 3/2007 | Sharrah et al. | |
| D548,385 | S | 8/2007 | Sharrah et al. | |
| 7,614,765 | B2 | 11/2009 | Reason | |
| D611,629 | S | 3/2010 | Sharrah et al. | |
| 8,287,157 | B2 | 10/2012 | Sharrah et al. | |
| 8,360,612 | B2 | 1/2013 | Redpath et al. | |
| 8,672,513 | B2 | 3/2014 | Redpath et al. | |
| 9,772,163 | B2 | 9/2017 | Sharrah et al. | |
| 2004/0012962 | A1 | 1/2004 | Wolf | |
| 2004/0047145 | A1 | 3/2004 | Koren | |
| 2005/0122710 | A1 | 6/2005 | Kim | |
| 2005/0185403 | A1 | 8/2005 | Diehl | |
| 2006/0233215 | A1 | 10/2006 | Casazza | |
| 2009/0067459 | A1 | 3/2009 | Mizuuchi et al. | |
| 2009/0086489 | A1 | 4/2009 | Scott et al. | |
| 2009/0185377 | A1 | 7/2009 | Johnson | |
| 2011/0157486 | A1 | 6/2011 | Murata et al. | |
| 2011/0163698 | A1 * | 7/2011 | Spartano | F21L 4/027 315/362 |
| 2012/0326635 | A1 | 12/2012 | Redpath et al. | |
| 2014/0268703 | A1 | 9/2014 | Ehlert et al. | |
| 2015/0276347 | A1 | 10/2015 | Sharrah et al. | |
| 2016/0018071 | A1 | 1/2016 | Sharrah et al. | |

OTHER PUBLICATIONS

Wikipedia, "Diffraction Grating", date last modified Feb. 13, 2016, 9 pages, https://en.wikipedia.org/wiki/diffraction_grating.

Wikipedia, "Double-slit experiment", date last modified Feb. 6, 2016, 12 pages, https://en.wikipedia.org/wiki/double-slit_experiment.

Physics Classroom, "Young's Experiment", printed Feb. 16, 2016, 4 pages, http://www.physicsclassroom.com/class/light/lesson-3/young-s-experiment.

Yahoo.com, "Diffraction Grating Yourng's Experiment—Yahoo Image Search Results", printed Feb. 16, 2016, 5 pages, https://images.search.yahoo.com/yhs/search;ylt=a0levrcuhmnwhvyau1ynni1q;_ylu=x3odmteybxv.

RP Photonics Encyclopedia of Laser Physics and Technology, "Beam Splitters", printed Jun. 15, 2017, 2 pages, https://www.rp-photonics.com/beam_splitters.html.

Edmund Optics, "What are Beamsplitters?", printed Jun. 15, 2017, 5 pages, https://www.edmundoptics.com/resources/application-notes/optics/what-are-beamsplitters/.

Wikipedia, "Beam Splitter", last edited Mar. 21, 2017, printed Jun. 15, 2017, 6 pages, https://en.wikipedia.org/wiki/beam_splitter.

PCT International Searching Authority, "Notification of Transmittal of the International Search Report and the Written Opinion of the International Searching Authority, or the Declaration", in International Application No. PCT/US2018/040249, dated Sep. 21, 2018, 10 pages.

* cited by examiner

FRONT

REAR

PORTABLE LIGHT WITH PLANE OF A LASER LIGHT

This application claims the benefit of U.S. Provisional Patent Application No. 62/325,917 entitled "PORTABLE LIGHT WITH LASER" filed Apr. 21, 2016, which is hereby incorporated herein by reference in its entirety.

The present invention relates to a portable light and in particular, to a portable light with an illumination light source and a laser providing a plane of laser light.

Strong and reliable portable lights are important to the safety of personnel who must enter hazardous and/or dangerous locations. Lights intended for use in such locations often have special circuitry to reduce the danger from high temperatures and/or sparks, and/or have special light producing configurations that improve the ability of a user to see while in hazardous locations. Often the users of such lights may be firefighters, police, security, environmental specialists, military and other first responder personnel, as well as military and rescue personnel in such environments, who may risk health and life in such areas.

Such portable lights are used in many environments to provide illumination and to enable personnel to operate in those environments. In certain environments, visibility may be reduced by smoke, particles, fog, steam, mist, rain, snow and/or other matter suspended or floating in the air. Often these kinds of environments may be hazardous and/or dangerous to personnel, and so the reduced visibility created by such environments can increase the level of hazard and/or danger. Lights for use in these environments may include special optical elements that form and/or direct the light beam produced by the light in ways thought to improve their ability to "cut through" the particle-filled air, thereby to improve visibility.

Typically, a bright light is necessary to penetrate such environments, however, such environments tend to reflect light back towards the portable light and thereby can tend to "blind" the personnel using the portable light. Peripheral light is particularly offensive when reflected back. One way to reduce this reflection-induced blinding is to employ a highly collimated beam of light thereby to reduce any peripherally projected light.

Conventionally, lights employ a highly collimating parabolic reflector and an opaque cover, e.g., as by a black opaque area on an incandescent light source, to block peripheral light. Thus the light intensity at the center of the light beam is increased relative to the intensity at the periphery thereof.

An example of such light includes the SURVIVOR® light available from Streamlight, Inc. of Eagleville, Pa., which produces a high-intensity light formed into a relatively tight spot beam for reducing side reflected light. A recent version of the SURVIVOR® light includes a removable selectable beam modification element, which may be either opaque or colored, that fits into a recess in a solid optical element in a way to improve visibility in certain reduced and/or limited visibility environments, and which is described in U.S. Pat. No. 9,488,331 entitled "PORTABLE LIGHT WITH SELECTABLE OPTICAL BEAM FORMING ARRANGEMENT" which was issued Nov. 8, 2016, and is hereby incorporated herein by reference in its entirety.

However, when a light having a highly collimated spot beam is employed in other environments, the absence of peripheral light may be a disadvantage.

With the advent of modern high light output solid state light sources, e.g., light emitting diode (LED) light sources, a parabolic reflector is less efficient because the LED does not emit light relatively evenly over a complete spherical volume as does an incandescent source. Typically, modern LEDs include an integral curved plastic lens so as to produce light relatively evenly over a hemispherical volume. Typically, many modern LED lights employ an optical arrangement in which internal reflection of light within an optical element is utilized to shape a forward projecting collimated light beam. Also typically, a level of peripheral light is provided by light that is directly emitted from the LED and/or by light diffusing elements to redirect light toward the periphery of the light beam. A permanent opaque plate has been employed to block the direct forward projected light from the LED.

However, even with lessening of the negative effect of peripheral light, Applicant believes there is a need for a portable light that allows individuals to better discern the physical features of environments, e.g., structures and objects therein, in a limited visibility environment, e.g., one in which smoke, mist, particles, fog, steam and/or other matter may be suspended or floating in the air.

Applicant believes there may be a need for a light that may provide improved discernment in a limited visibility environment.

Accordingly, a portable light may comprise: a light body having an illumination light source and a laser light source supported thereby, each source selectively energizable for producing light; and a switch for selectively energizing the white light and/or laser light source. The laser light source may be configured to provide a plane of laser light, so as to create a line of laser light on objects illuminated by the laser light plane. In this regard, the laser light source may include a cylindrical lens to create the light plane. A TIR optical element may also be disposed in front of the white light source for receiving the light produced thereby, and form the white light into a collimated beam of light, the TIR optical element having a recess in a forward face thereof. A selectable beam modification element may be placeable into and removable from the recess in the forward face of the TIR optical element.

Also, a portable light may comprise: an illumination light source and a laser light source supported by a light body and each selectively energizable by a switch for producing illumination light; and the laser light source may include a cylindrical lens for transmitting a plane of laser light.

Accordingly, a portable light may comprise: light body; an illumination light source supported by the light body relatively remotely to a base end thereof, configured to emit illumination light in a predetermined direction and being selectively energizable by a switch for producing illumination light; a laser light source supported by the light body relatively nearer to the base end thereof and being selectively energizable by the switch for producing laser light, wherein the laser light source includes a cylindrical lens configured for transmitting a plane of laser light in substantially the predetermined direction.

Accordingly, a portable light may comprise: a light body; an illumination light source supported by the light body and selectively energizable for producing illumination light, wherein the illumination light source includes a shaped optically clear element having a forward surface through which the illumination light exits; and a laser light source supported by the shaped optically clear element and selectively energizable for producing laser light, wherein the laser light source includes a cylindrical lens configured for transmitting a plane of laser light in substantially the same direction as the illumination light.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1A:
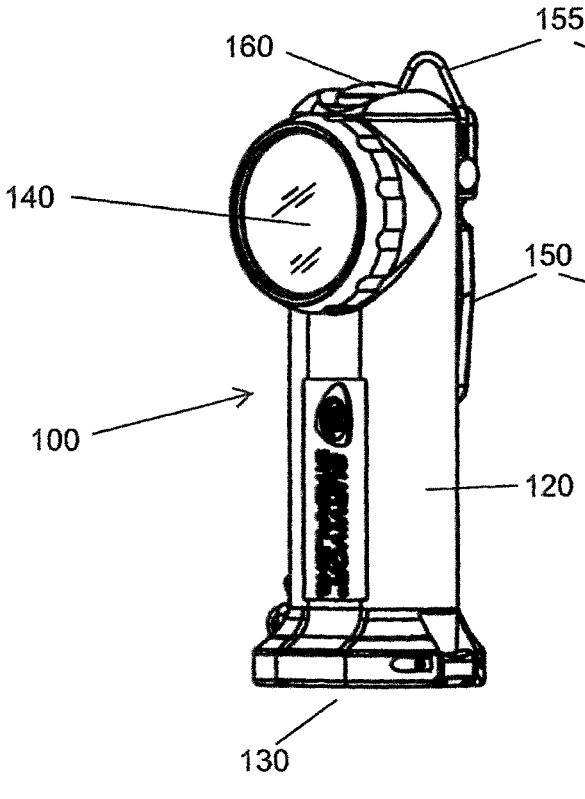
FIGS. 1A and 1B are front and rear perspective views of an example embodiment of a portable light with a laser light source.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

Figure 1B:
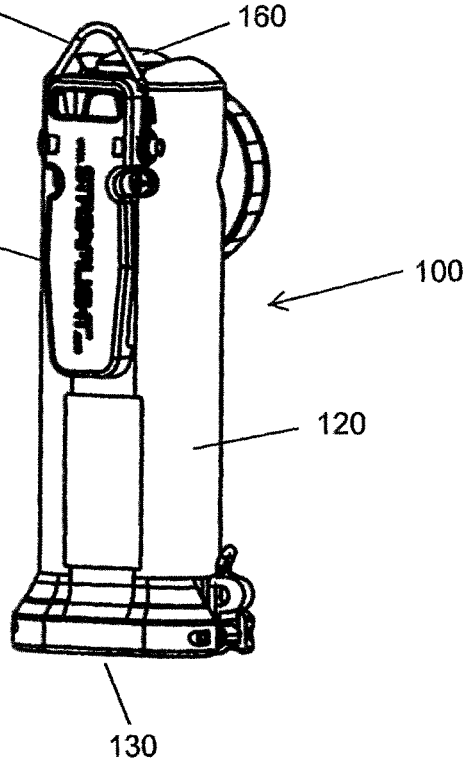
Figure 1C:
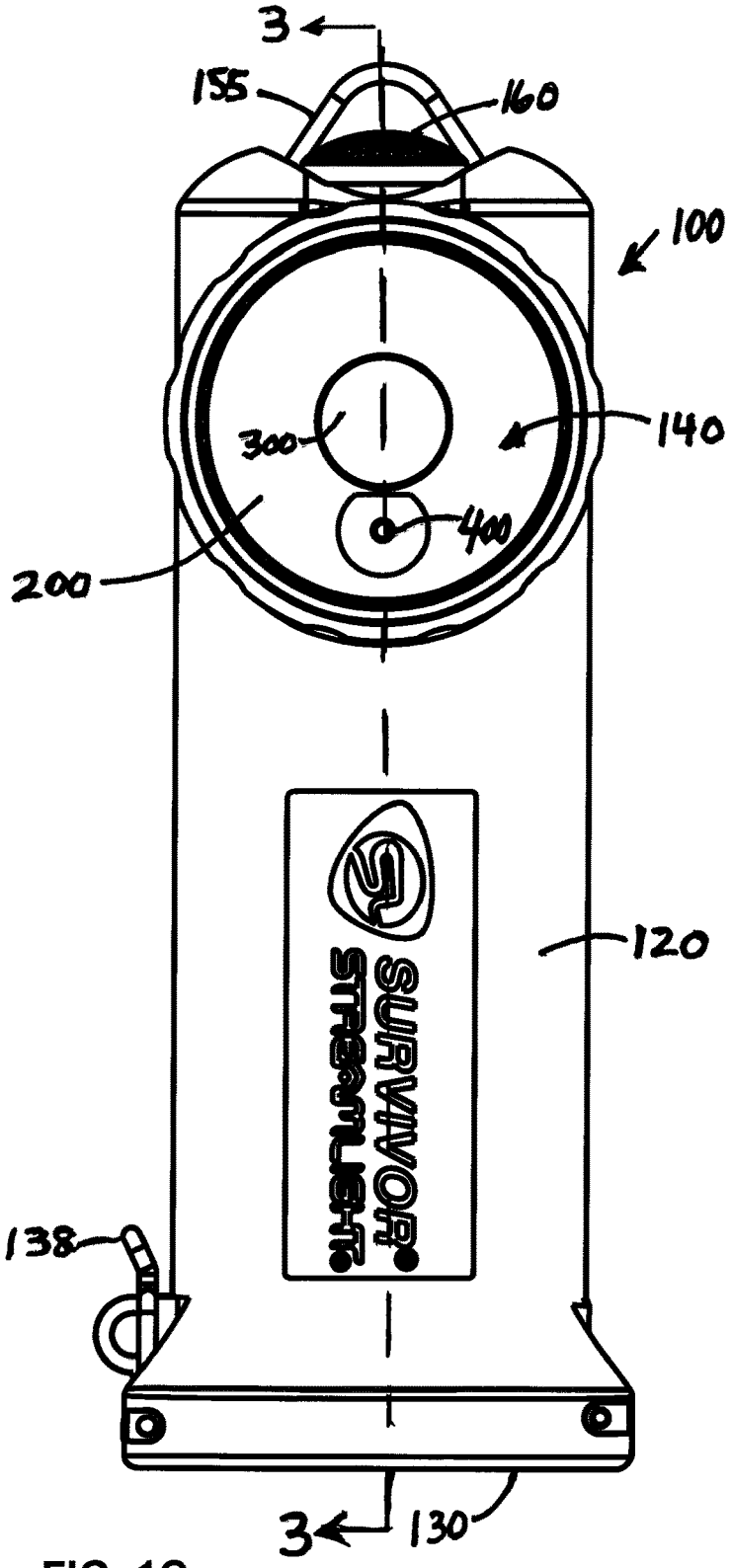
FIGS. 1C and 1D are front and rear views thereof.
Figure 1D:
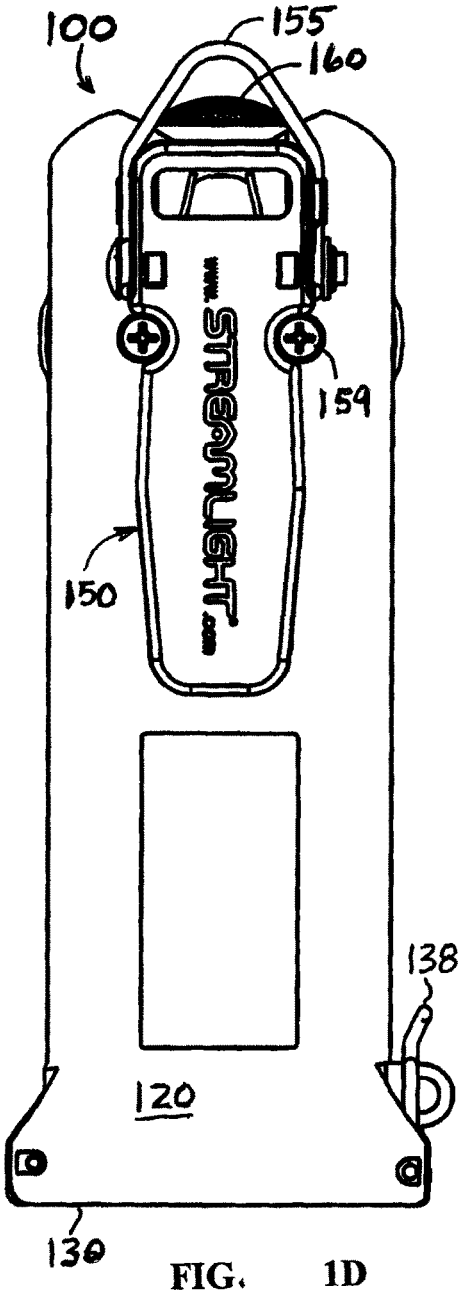
Figure 1E:
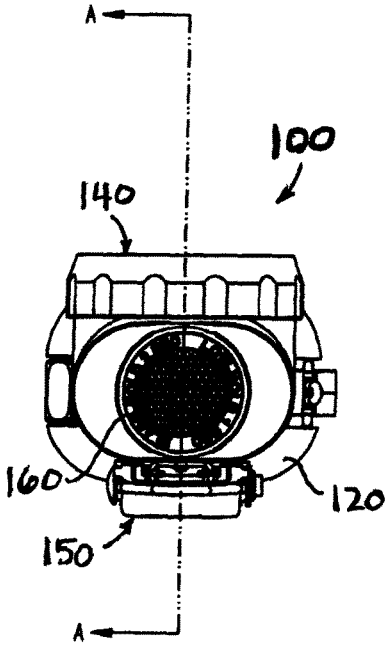
FIGS. 1E and 1F are top and bottom views thereof, respectively.
Figure 1F:
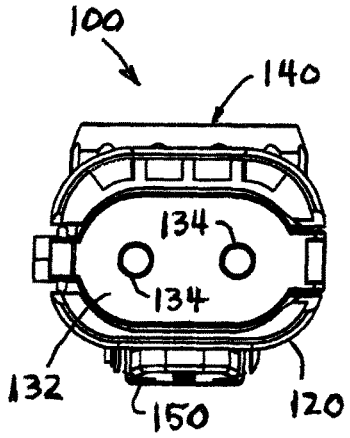
Figure 2:
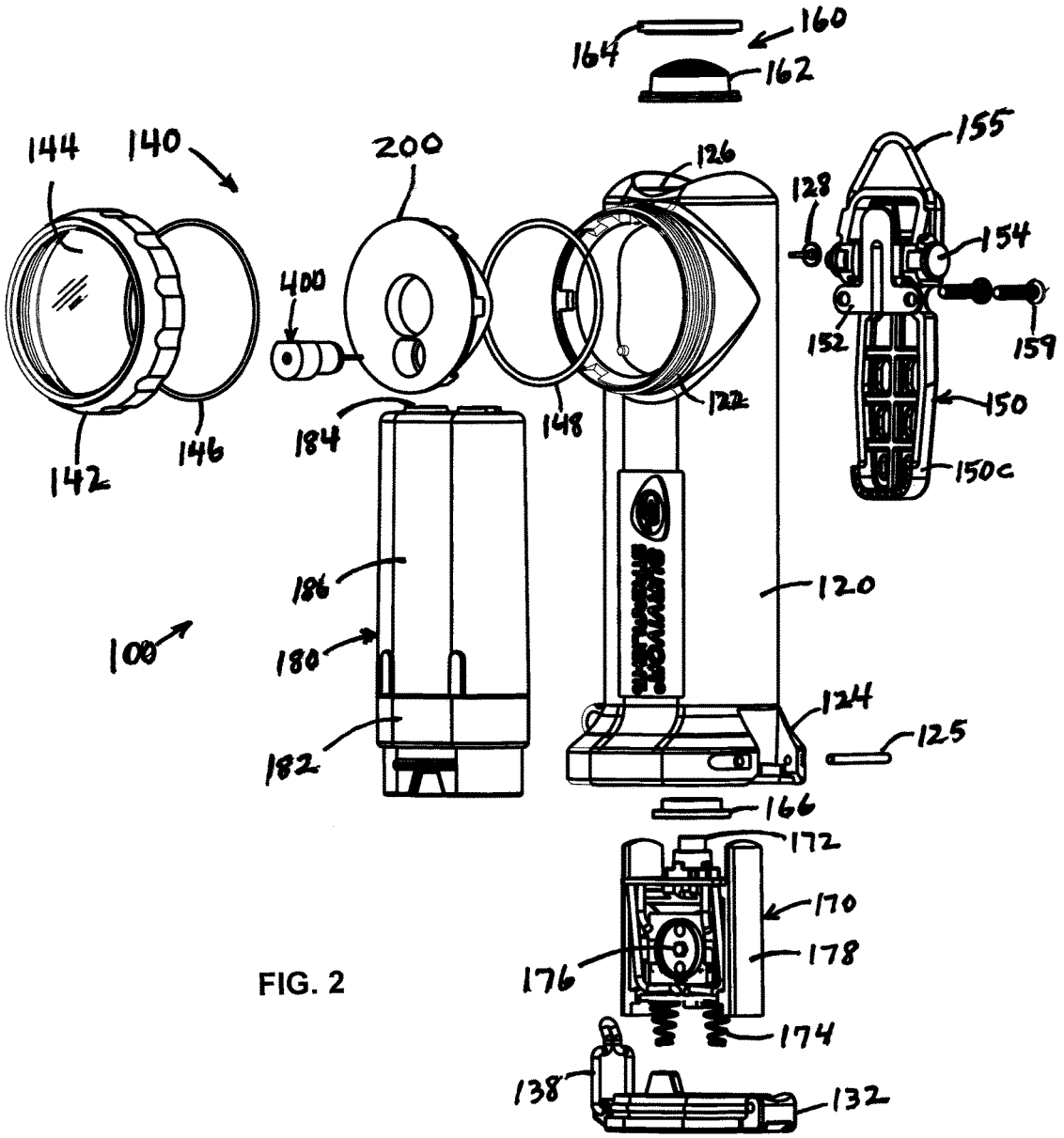
FIG. 2 is an exploded perspective view of the example portable light of FIG. 1.
Figure 3:
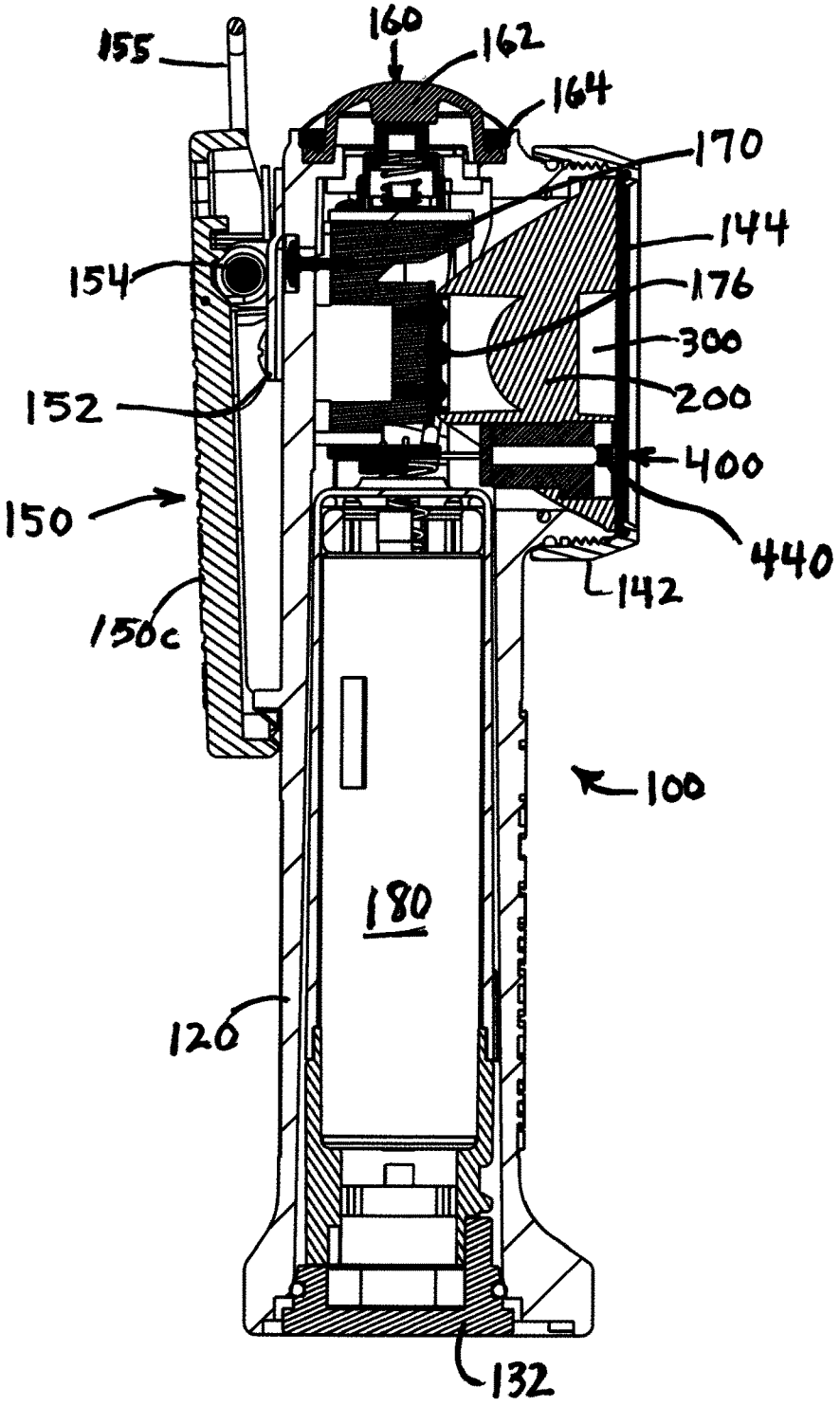
FIG. 3 is a cross-sectional view of FIG. 1C.

FIGS. 1A and 1B are front and rear perspective views of an example embodiment of a portable light 100 with a laser light source, FIGS. 1C and 1D are front and rear views thereof, and FIGS. 1E and 1F are top and bottom views thereof, respectively; FIG. 2 is an exploded perspective view of the example portable light 100 of FIG. 1; and FIG. 3 is a cross-sectional view of the example portable light 100 including an example embodiment of an optical beam forming arrangement 200-300 with laser light source 400 therefor. Portable light 100 includes a body or housing 120 that is configured to have a base 130 upon which light 100 can rest, e.g., on a horizontal surface, and to have a light source 140 that when energized projects light in a direction substantially perpendicularly to the long axis (e.g., vertical axis) of body 120.

Light 100 preferably, but optionally, includes a clip 150 on light body 120 by which it can be attached (e.g., clipped) to an article of clothing or to equipment or to another object, e.g., a belt or strap or rope or bar, as well as a hanger or loop 155 by which it can be attached (e.g., hung) from an article of clothing or equipment or another object. Hanger 155 is attached to light body or housing 120 by a bracket, e.g., the bracket 152 that supports clip 150, and more specifically, hanger 155 is pivotable on the pivot or hinge pin 154 on which clip 150 pivots on that bracket 152 relative to housing 120.

A switch actuator 160 is provided for selectively energizing and de-energizing illumination light source 140, e.g., white light source 140, and laser light source 400, where the light sources 140, 400 may be energized separately, so that only one source 140, 400 is on at a given time. Preferably switch actuator 160 is at the upper end on body 120 where it can easily be actuated by a finger when light 100 is held in hand or can be pressed when light 100 is resting on a horizontal surface or is attached by clip 150 or hung by loop 155. Also preferably, light sources 140, 400 are proximate the upper end of light body 120.

Light body or housing 120 is preferably a hollow tube 120, e.g., a molded plastic tube, having a receptacle 1*b* for receiving elements, e.g., elements 142-148, 176, 200, 300 of white light source 140 extending substantially perpendicularly from the upper end of body 120, and having an opening 126 at the upper end thereof for receiving elements, e.g., elements 162-166, of switch actuator 160. A switch boot 162 of switch actuator 160 is attached over an opening 126 in the upper end of housing 120 by a switch ring 164 which is attached to housing 120, e.g., by adhesive or by welding or by another suitable method to sealingly attach boot 162 thereto. A switch spacer 166 is disposed behind switch boot 162 for transmitting a pressing of boot 162 to actuate an electrical switch 172 which is adjacent thereto when LED module assembly 170 is inserted into housing tube 120 through the opening at the base 130 thereof and is fully seated against the upper end thereof.

LED module assembly 170 includes, e.g., a heat sink structure 178 to an upper end of which is mounted electrical switch 172 and to a lower end of which are mounted a pair of spring contacts 174 for making electrical connections to a battery assembly 180. Heat sink structure 178 is substantially rectangular with two substantially parallel opposing sides thereof having extensions projecting upwardly and downwardly, e.g., to increase the heat sinking area and mass thereof. A preferably integral wall fills the rectangular center of heat sink 178 and thermally connects to all sides thereof and presents a mounting surface substantially in the plane of heat sink 178. Mounted to that mounting surface of heat sink structure 178 is a light emitting diode (LED) 176, which is also an element of illumination light source 140. LED 176 is mounted in a position to direct light substantially outward and away from that surface of heat sink 178 and around a perpendicular to the long axis of housing 120, e.g., into the base of optical element 200, as described below.

Battery assembly 180 includes an inner carrier structure 182 which carries, e.g., a plurality of battery cells (not shown) and provides interconnections therebetween and an outer carrier cover 186. Carrier 182 includes a pair of contacts 184 at its upper end, e.g., accessible through openings in the upper end of carrier cover 186, for making electrical connection to the spring contacts 174 extending from LED module 170. Battery assembly 180 may contain either single use battery cells or rechargeable battery cells. Where battery assembly 180 contains rechargeable battery cells, carrier cover 186 may be permanently attached to inner carrier 182. In that embodiment, battery assembly 180 preferably also provides a pair of contacts at its lower end for making electrical connection to optional connections 134 through battery door 132.

Battery door 132 is hinged by pin 125 engaging a clevis 124 at the base of housing 120 and preferably includes a pair of contacts 134 there through for connecting battery carrier 180 internal to light 100 to an external source of charging power, e.g., a charger base, when light 100 is placed therein for charging rechargeable batteries that may be utilized in light 100. Battery door 132 includes a pivotable clasp 138 for securing battery cover 132 in a closed position in housing 120, and may also include an O-ring, gasket or other seal for sealing the battery door end of housing 120.

White illumination light source 140 may be provided by an LED 176 of LED module assembly 170 in conjunction with elements 142-148, 200, 300. Optical element 200 is a shaped optically clear plastic element 210 that has a polished generally parabolic external side surface 240, a generally wider flat polished forward surface 220, and a shaped narrower rearward surface 230 that is disposed adjacent to LED 176 of LED module assembly 170. LED 176 may be surrounded by a raised ring sized and shaped to receive the rearward end 230 of optical element 200. Polished side surface 240 may be a generally parabolic surface or other suitably shaped surface to collimate the light produced by LED 176 into a desired beam, e.g., a collimated forward projecting white light beam.

Optical element 200 is covered by a lens 144 and both are retained in the threaded receptacle 122 of housing 120 by a lens ring 142. Preferably Lens ring 142 has threads, e.g., internal threads, that engage complementary threads, e.g., external threads, of receptacle 122 for securing lens ring 142, lens 144 and optical element 200 in housing 120. Preferably, but optionally, an O-ring 146 grommet 146 or other seal 146, may be provided between lens ring 142 and lens 144 to provide a seal thereat and housing 120 may have a second O-ring 148 around outer periphery of receptacle 122 for sealing between lens ring 144 and housing 120.

Preferably, but optionally, a pivotable clip assembly 150 includes a pivotable clip 150*c* and is attached at a bracket 152 thereof to housing 120 by one or more fasteners 159, e.g., two screws 159. Clip assembly 150 includes the clip 150*c* which is pivotably mounted to bracket or base 152 by a pivot pin 154, and has hanger or loop 155 that is pivotable by the ends thereof pivotably engaging hinge pin or pivot pin 154 on which clip 155 pivots. Housing 120 may be provided with a pressure relief valve 128, typically a resilient valve 128, disposed in an opening in housing.

Figure 4:
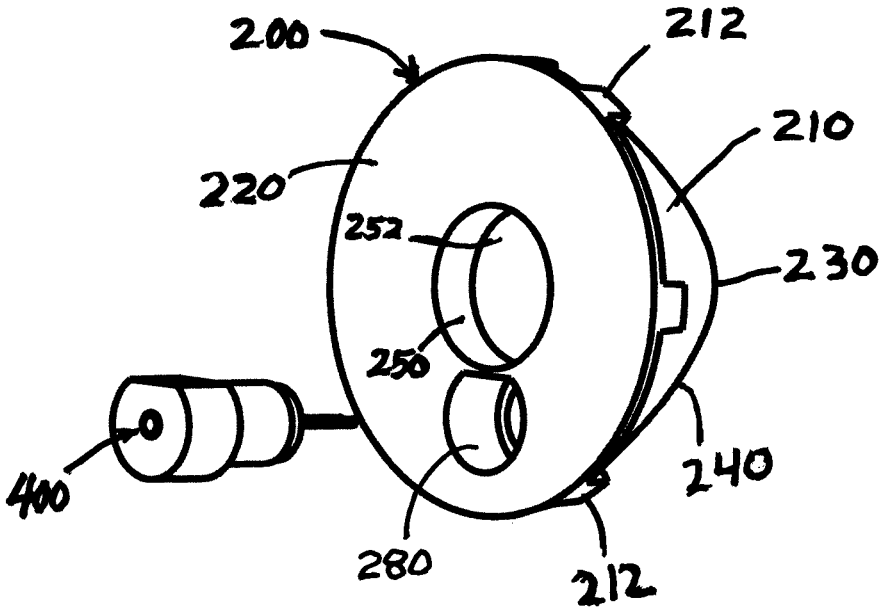
FIG. 4 is a perspective view of the example beam forming arrangement with a laser light source of FIG. 3.
Figure 5A:
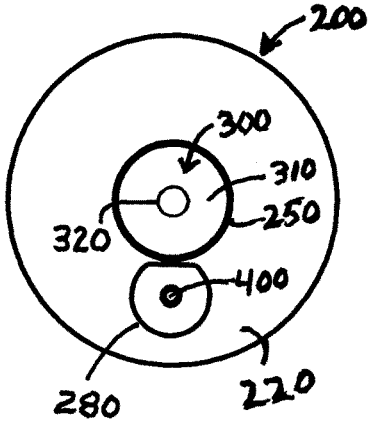
FIGS. 5A and 5B are first and second end views of the example optical beam forming arrangement with a laser light source of FIG. 4, and FIGS. 5C and 5D are side cross-sectional views of the example optical beam forming arrangement with a laser light source of FIG. 4 and of an alternative embodiment thereof, respectively.
Figure 5B:
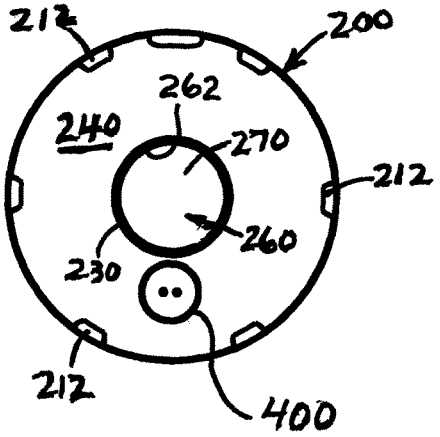
Figure 5D:
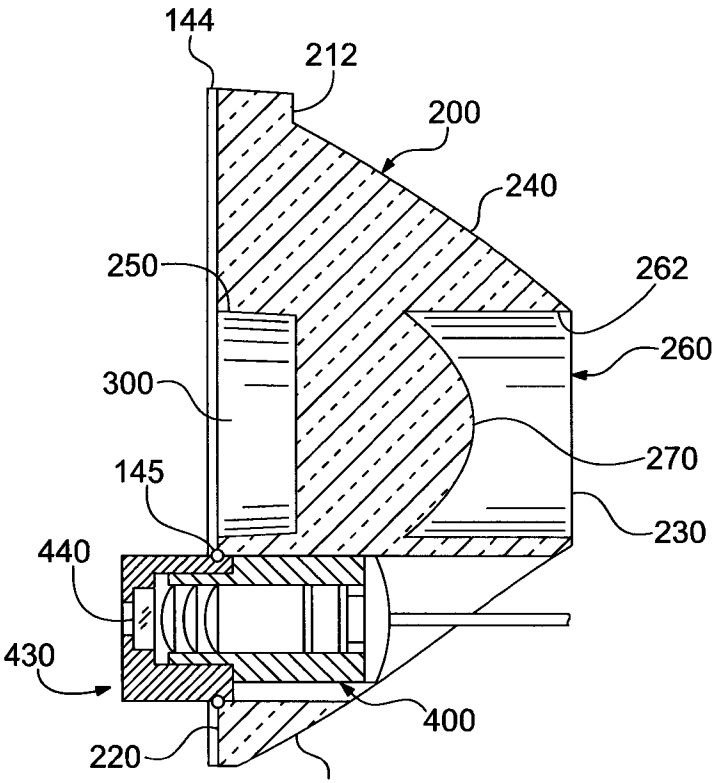
Figure 5C:
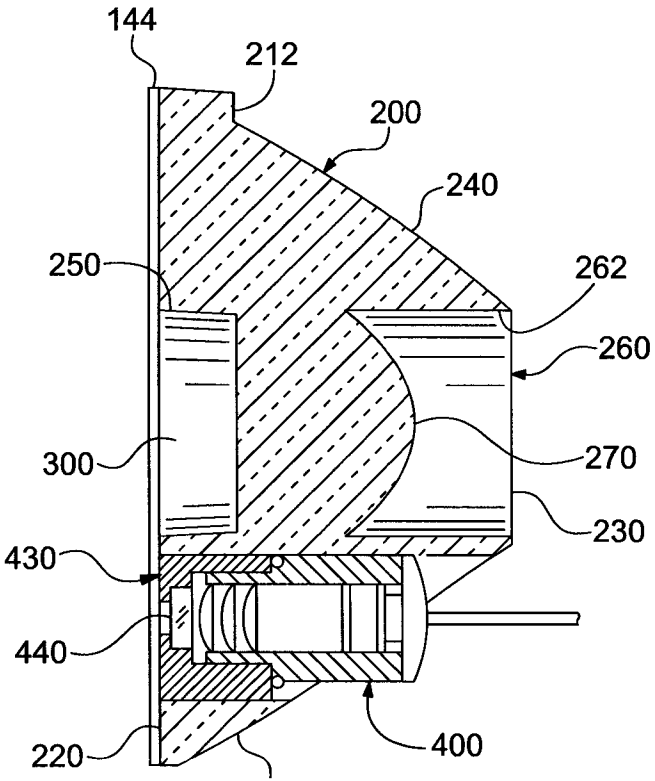

FIG. 4 is a perspective view of the example beam forming arrangement 200 of FIG. 3; FIGS. 5A and 5B are first and second end views of the example optical beam forming arrangement 200 with a laser light source 40 of FIG. 4, and FIGS. 5C and 5D are side cross-sectional views of the example optical beam forming arrangement 200 with a laser light source 400 of FIG. 4 and of an alternative embodiment thereof, respectively. Optical element 200 is a shaped optically clear plastic element whose optically clear body 210 has a curved polished side surface 240, a generally wider flat polished forward surface 220, and a narrower rearward shaped surface that is disposed adjacent to LED 176 of LED module assembly 170 as described. Light, typically white light, produced by LED 176 enters optical element 200 through the rearward end 230 thereof, is essentially totally internally reflected therein to form a highly collimated beam of light, and exits optical element 200 at the flat forward exit surface 220 thereof. Thus the totally internally reflective (TIR) optical element 200 serves to redirect the rays of light emitted by LED 176, which are emitted therefrom substantially radially into a substantially hemispherical volume, into substantially parallel rays of light defining a highly collimated beam of light that exits forward surface 220 of optical element substantially parallel to the central axis, e.g., the axis of optical symmetry, thereof.

More specifically, light emitted by LED 176 impinges on and is refracted by the side wall of the rearward cylindrical recess 260 and into the body 210 of optical element 200 wherein it is totally internally reflected (TIR) by external curved surface 240 to exit via the flat forward face 220 thereof as a highly collimated beam. While most of the light entering via the side wall 262 of cylindrical recess 260 is believed to come directly from LED 176, LED 176 is not a true point source and so some rays may be reflected by surface 270 towards side wall 262. Because optical element 200 is highly efficient in collecting and in internally reflecting and collimating the light emitted by LED 176, very little light is emitted toward the periphery of optical element 200.

A substantially cylindrical recess 260 at the rearward end of optical element 200 has a curved convex bottom 270 for refracting light from LED 176 into optical body 210 in a direction towards the bottom 252 of cylindrical recess 250 in the flat forward surface 220 thereof, from which it exits optical element 200. Preferably, the light exiting optical element 200 is diffused through the textured bottom surface 252 of recess 250 to provide peripheral light. The cylindrical recess 250 provided in the flat forward face 220 of optical element 200 in an available embodiment thereof has a flat textured bottom surface 252 so as to diffuse light from LED 176 that impinges upon surface 252 thereby to provide the peripheral light.

Because peripheral light is sometimes desirable and sometimes is not desirable, Applicant provides a selectable beam modification element 300 that enables a user to easily reconfigure portable light 100 to provide the desired level of peripheral light. A removable beam modification element 300, e.g., a removable plug element 300, may be disposed in the cylindrical recess 250 in the forward surface of optical element 200, whereat is can block or otherwise modify one or more characteristics of the light exiting through surface 252, e.g., which can provide peripheral light. Preferably removable beam modification element 300, e.g., removable plug element 300, has an opaque body or base 310 so as to maximize the peripheral light that it blocks.

It has been found that if the peripheral light is amber in color, it can be less objectionable and less fatiguing to a user than is white peripheral light, at least in some environments. Accordingly, a removable beam modification element 300, e.g., removable plug element 300, that has a body 310 of transparent or translucent amber colored material, e.g., plastic, may be provided, either in place of and/or in addition to an opaque plug 300, to modify the color or the intensity or both of the peripheral light, e.g., to be amber in color.

One example embodiment of removable beam modification element 300, e.g., removable plug element 300, preferably comprises an opaque cylindrical body 310 having a diameter that is slightly smaller than the diameter of the cylindrical recess 250 in the forward face of optical element 200 and being of lesser thickness than the depth thereof.

Intuitively, one might expect that placing an opaque beam modification element 300 directly in front of LED light source 176 would substantially diminish the light intensity at the center of the light beam emitted by light 100 and would have little effect upon the intensity of peripheral light, which beam modification element 300 does not appear to be in position to affect. Surprisingly, however, Applicant has found that the light intensity of the light near the center of the emitted light beam is not substantially diminished by beam modification element 300 while the intensity of the peripheral light is substantially diminished or otherwise modified.

Optical element 200 may include on optical body 210 thereof one or more orientation defining features 212, e.g., one or more projections 212, that may engage one or more corresponding orientation features, e.g., one or more recesses, in the housing 120, 122 into which optical element 200 is placed. Where the orientation of optical element 200 in housing 120, 122 is desired to be a particular orientation, then orientation features 212 may be arranged in a non-symmetrical pattern.

Selectable beam modification element 300 is preferably of a size and shape corresponding to that of the recess 250, preferably a cylindrical recess, e.g., recess 250, in the forward face of optical element 200 so that it can easily be placed into that recess and can easily be removed from that recess, thereby to reconfigure portable light 100 to produce a lesser and a greater level of peripheral light. Typically, and preferably, the base of selectable beam modification element 300 may be a cylindrical disk having a diameter that is slightly less than that of the cylindrical recess of optical element 200, and having a thickness (or length) that may be the same as, less than or greater than the depth of the cylindrical recess.

Preferably, but optionally, removable beam modification element 300 may have a raised gripping member 320, e.g., a raised ridge 320 or a sphere 320 on a short post, so that removable beam modification element 300 may easily be gripped and removed from the cylindrical recess 250 in optical element 200.

Selectable beam modification element 300 may be removably retained in the recess 250 of optical element 200 in any one or more of a variety of different arrangements. For example, selectable beam modification element 300 may be removably retained in the recess of optical element 200 by friction, or may have a resilient periphery that contacts the inner surface of the recess 250 in optical element 200, or may be of a resilient material and of a diameter to contact the inner surface of the recess 250 in optical element 200, or may have an O-ring in a peripheral groove that contacts the inner surface of the recess 250 in beam modification element 300, or may be retained by pressure where the difference between the diameters of selectable beam modification element 300 and the recess 250 are small. In the illustrated embodiment, selectable beam modification element 300 is retained by a cover provided by lens 10 and lens ring 11, however, a cover of a different form, e.g., a press in or snap in cover, may also be employed.

Further, selectable beam modification element 300 may be opaque or may be transparent or translucent and of any desired color, or plural different beam modification elements 300 may be provided with light 100. For example, selectable beam modification element 300 may be of a transparent amber colored material so that the peripheral light is amber in color which is believed to be less fatiguing when reflected by smoke or other particulates in an environment. The intensity of the peripheral light is directly related to the light transmissibility of the material from which selectable beam modification element 300 is made, and so the material employed may be selected to provide a desired level of peripheral light intensity. Further, selectable beam modification element 300 may be of materials of other colors, e.g., red, blue, green, yellow and the like, as may be desired for coloring the peripheral light for a given environment and/or preference, or for merely distinguishing by its color one light 100 from another light 100.

As a result of selectable beam modification element 300 being removably retained in optical element 200, portable light 100 is easily configurable and reconfigurable by a user to produce a beam of light having a lesser peripheral light intensity or a greater peripheral light intensity, as well as to configurations producing peripheral light of different colors and/or intensities.

Figure 6A:
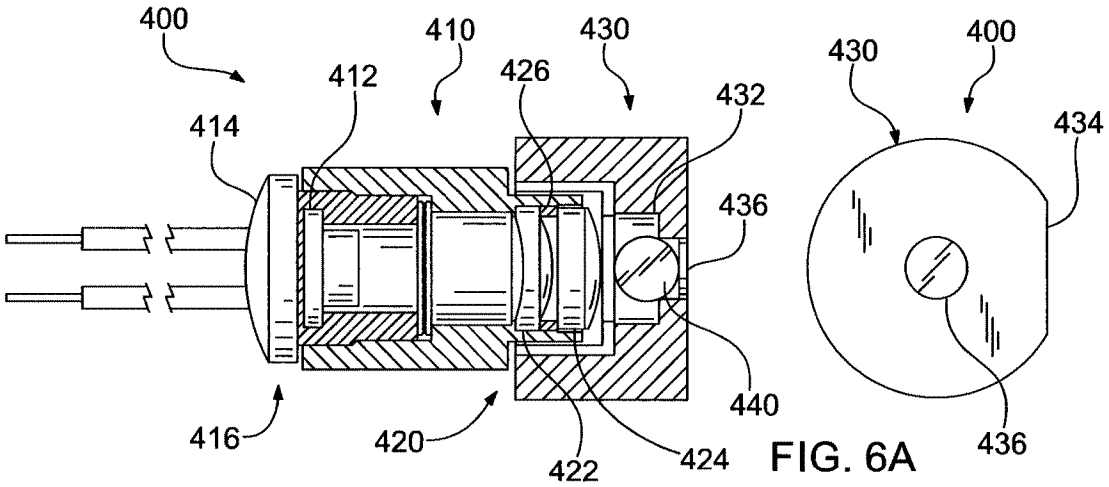
FIGS. 6A, 6B and 6C are side cross-sectional, end and plan views, respectively, of an example laser light source of FIG. 4.
Figure 6C:
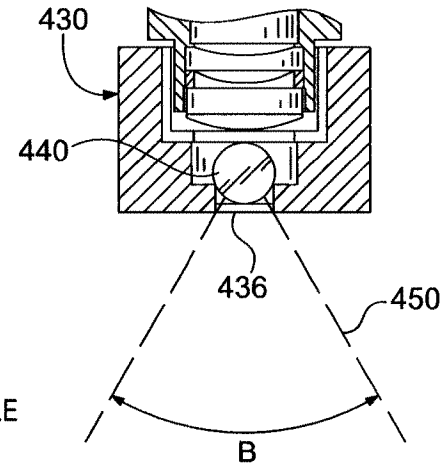
Figure 6B:
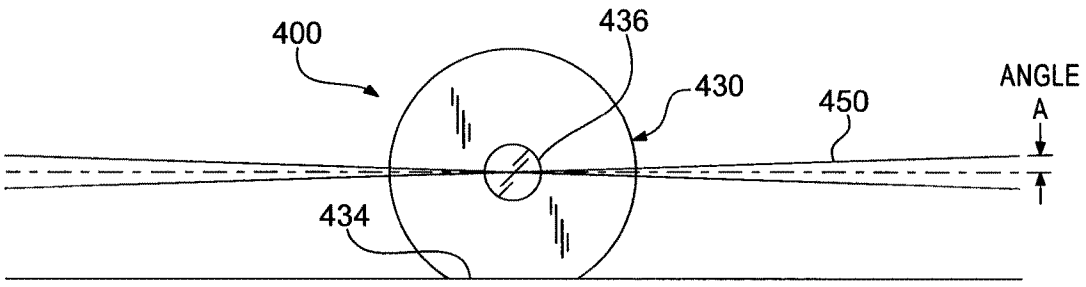

In addition, because white light is sometimes not desirable, Applicant also provides laser light source 400 that may be configured to provide a plane of laser light to illuminate objects in a reduced visibility environment, such as a smoke-filled room. FIG. 6A is a side cross-sectional view of the example laser light source 400, and FIGS. 6B and 6C are an end view and a plan view, respectively, of the laser light source 400 showing the light plane 450. Laser light source 400 includes a laser emission element 410, a laser lens assembly 420 and a lens supporting element 430 in which is disposed a cylindrical lens 440.

The laser light source 400 may include a cylindrical lens 440 for receiving light from a laser emission element 402, such as a red laser diode, and for transmitting the received light as the plane of laser light 450. The laser light source 400 may include a registration feature 434 on an external surface thereof disposed in registration with a longitudinal axis of the cylindrical lens 440. In particular, the registration feature 434 may have an axis oriented perpendicular to the longitudinal axis of the cylindrical lens 440 whereby the plane of laser light 450 is substantially parallel to the flat surface of registration feature 434.

The laser light source 400 may be mounted to the flat forward exit surface 220 interior to the optical element 200, e.g., in a recess 280 therein. One might also expect that placing the laser light source 400 in the path of LED light source 176 would substantially diminish the light intensity of the white light beam emitted by light 100. Surprisingly, however, Applicant has found that the light intensity of the light of the emitted white light beam is not substantially diminished by the presence of laser light source 400 in the recess 280 of TIR optical element 200, 210. Perhaps the light from LED 176 traveling in TIR optical element is reflected at the interface of recess 280 to remain within optical element 280 until it exits at flat front surface 220.

In an example laser light source 400, the laser assembly 410 includes a sleeve or housing 416 that supports a laser emitting element 412 on an electronic circuit board 414 to emit laser light toward laser lens assembly 420. Laser lens assembly 420 includes lenses and baffles, such as first focus lens 422 and second focus lens 424 with a baffle 426 therebetween, so as to form the laser beam from emission element 412 into a tightly focused spot beam. Typically, one or more electrical wires exit at the rear of housing 416 for providing electrical connections for energizing laser emitting element 412.

A cylindrical lens supporting element 430 is disposed at the forward end of laser assembly 410 for supporting a cylindrical lens 430 in a lens seat 432 therein and has an aperture 436 through which the plane 450 of laser light exits laser light source 400. Lens seat 432 seats cylindrical lens 430 in a predetermined orientation relative to the flat registration feature 434 on the exterior surface of lens support 430 and laser light source 400 so that the orientation of the plane 450 of laser light emanating from cylindrical lens 440 and laser light source 400 is in a predetermined orientation relative to registration feature 434. Lens support 430 has a lens cup at the rearward end thereof into which laser lens assembly 420 is disposed, thereby to predetermine the relative positions thereof so that the exit of lenses 420, 422, 424 is closely adjacent to cylindrical lens 440 and to reduce the overall length of laser light source 400.

In the example illustrated, cylindrical lens 440 is seated in lens seat 432 of support 430 so that its longitudinal axis is perpendicular to the registration feature 434 so that the plane 450 of laser light exiting cylindrical lens 440 is substantially parallel to the flat surface of registration feature 434.

Consequently, because the orientation of the plane 450 of laser light emitted from laser light source 400 is in a predetermined orientation relative to registration feature 434 thereof, the mounting of laser light source 400 in light 100 can be in a predetermined orientation relative to light 100. In the example illustrated, with light 100 resting on a horizontal surface on its base 130 so that its longitudinal axis is vertical, the flat registration feature of recess 280 of TIR optical element 200 is substantially horizontal, whereby the flat registration feature 434 of laser light source 400 is substantially horizontal as is the plane 450 of the laser light emitted therefrom. With the plane 450 of laser light being substantially horizontal, it is likely to illuminate substantially vertical features, e.g., walls, doorways, posts and openings in the floor. A user of light 100 could move light 100, e.g., by rotating its longitudinal axis away from vertical, so as to change the orientation of laser light plane 450 to a different, e.g., non-horizontal, orientation where it may better define physical features, objects and structure in a reduced visibility environment.

While laser light source 400 is illustrated as projecting a plane 450 of laser light outwardly in a direction that is generally transverse to the longitudinal axis of housing 120, laser light source 400 may be angled such that the plane 450 of laser light is substantially parallel to the axis at which light is emitted by illumination light source 140 or may be angled, e.g., downwardly, to diverge from the illumination light. The latter is thought to make it easier for a user to discern objects in certain reduced vision environments, as is the embodiments wherein laser light source 400, and the plane 450 of laser light therefrom, may be rotated by a user.

The plane 450 of laser light may also be referred to as a line of laser light, e.g., because it appears as a line on objects upon which it impinges and/or because the laser module 400 may be described as providing a line of laser light and/or may be employed to provide a line of laser light. The laser light from laser module 400 appears as a line, e.g., as viewed in FIG. 6B, and appears as a triangular plane, e.g., as viewed in FIG. 6C.

Figure 7B:
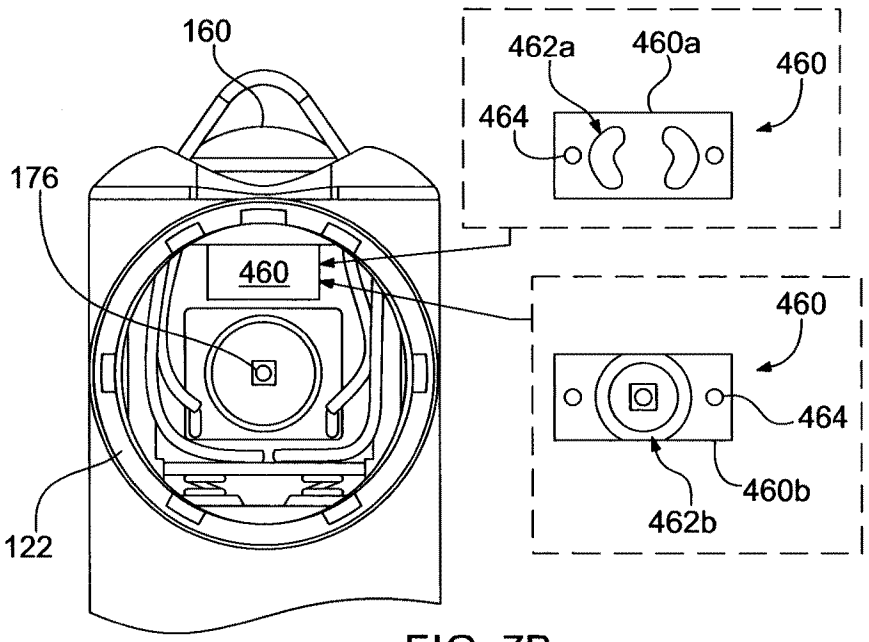
FIG. 7B is a front view of the example light with the example optical element removed.
Figure 7A:
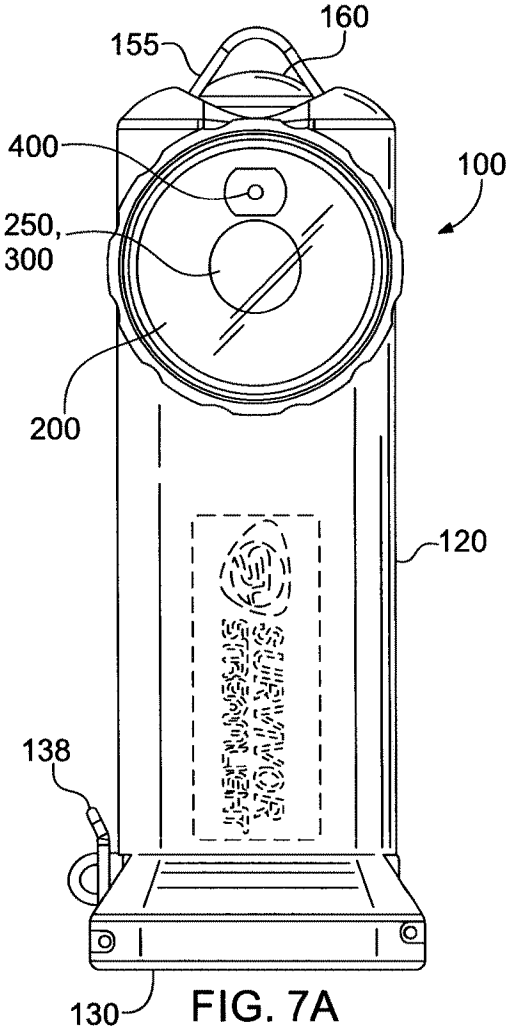
FIG. 7A is a front view of the example light illustrating an alternative position for the laser light source.
Figure 7D:
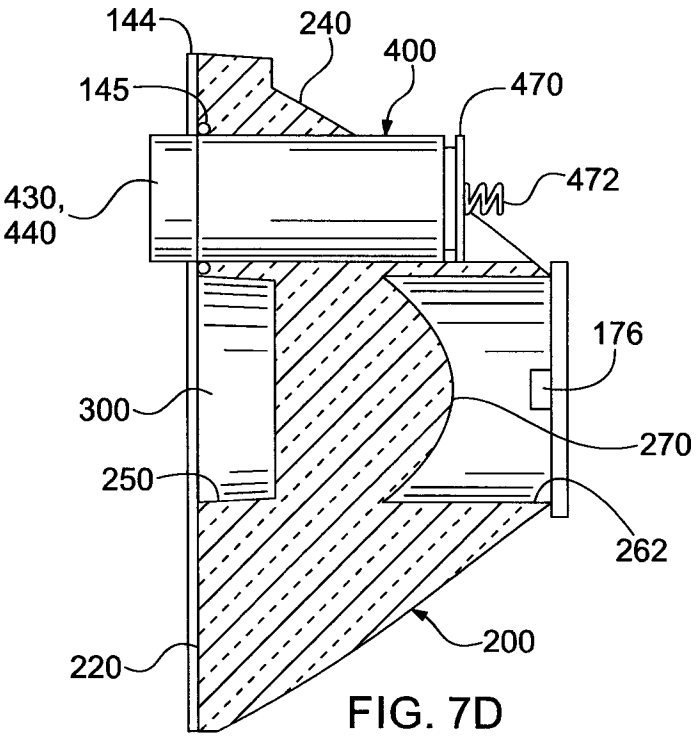
FIGS. 7C and 7D illustrate alternative mounting of the example laser light source in the example optical element including for rotatability of the example laser light source.
Figure 7C:
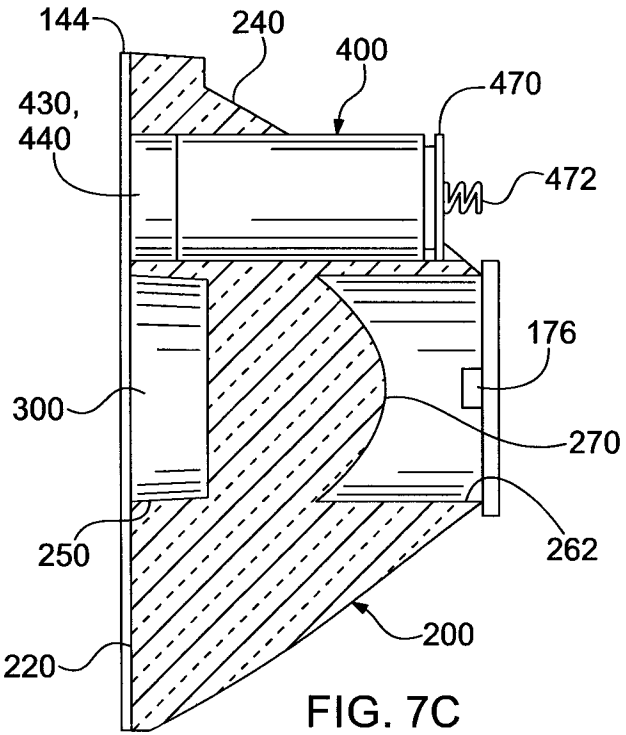

FIG. 7A is a front view of the example light 100 illustrating an alternative position for the laser light source 400, FIG. 7B is a front view of the example light 100 with the example optical element 200 removed to render a portion of the interior thereof visible, and FIGS. 7C and 7D illustrate alternative mounting of the example laser light source 400 in the example optical element 200 including for rotatability of the example laser light source 400. Therein, laser light source 400 is supported by optical element 200 in a position that is between recess 250 for beam modification element 300 and actuator 160, e.g., such that the laser light source 400 is above recess 250 for beam modification element 300 when light 100 is resting with its base 130 on a surface, or when it is hanging by hanger or loop 150. Otherwise portable light 100 is substantially as previously described.

With the optical element 200 and laser light source 400 removed as illustrated in FIG. 7B, a portion of the interior of light 100 is visible. LED light source 176 is supported by LED module assembly 170 and above LED 176 is seen an electrical circuit board 460 that is, e.g., also supported by module assembly 170, has connections 464 to the source of electrical power for laser light source 400, and has an arrangement of contacts 462 configured for making contact with electrical contacts 472 at or near the rear of laser light source 400. Laser light source 400 may include a small circuit board 470 to which the electrical wires from laser light source connect and which has one or more, e.g., two, electrical contacts 472 extending rearwardly so as to make physical and electrical contact with contacts 462 of circuit board 460 when optical element 200 with laser light source 400 therein is disposed in the receptacle 122 therefor in light housing 120. Preferably, contacts 472 each comprise an electrically conductive spring 472, e.g., a cylindrical or helical or conical spring 472.

Where laser light source 400 is mounted in a fixed orientation in optical element 200, circuit board 460 is a circuit board 460*a* which has two side-by-side electrical contacts 462*a*, e.g., one for making contact with a respective one of side-by-side spring contacts 472, e.g., approximately at "3-o'clock" and "9-o'clock" positions on circuit board 470. To allow for tolerance, contacts 462*a* may be made, and preferably are made, larger than is needed to receive the ends of contact springs 472. In one example embodiment, electrical contacts 462*a* are wider than the ends of contact springs 472 and have opposing complementary arcuate shapes so as to accommodate any rotational tolerance in the mounting of laser light source 400 and/or circuit board 470 thereon, as well as any alignment tolerances of spring contacts 472.

Where laser light source 400, or at least the end cap 430 thereof that supports cylindrical lens 440, is rotatable in optical element 200, circuit board 460 is a circuit board 460*b* which has two electrical contacts 462*b*. One contact 462*b* is centrally located on circuit board 460B for making contact with one of spring contacts 472 that is centrally located on circuit board 470 and one contact 462*b* being a ring-shaped contact 462*b* surrounding the centrally located contact 462*b* for making contact with a second one of spring contacts 472 that is spaced apart from the central contact 472 by a distance substantially equal to the radius of the ring contact 462*b*. To allow for tolerance, contacts 462*b* may be made, and preferably are made, larger than is needed to receive the ends of contact springs 472. In one example embodiment, both electrical contacts 462B are wider than are the ends of contact springs 472 so as to accommodate any rotational and/or diametrical tolerance in the mounting of laser light source 400 and/or circuit board 470 thereon, as well as any alignment tolerances of spring contacts 472.

In FIG. 7C laser light source 400 is supported by optical element 200 behind the lens 144, similarly to that previously described. In FIG. 7D laser light source 400 is supported by optical element 200 such that the forward portion 430 of laser light source 400, e.g., the cylindrical lens supporting element 430, extends through an opening in lens 144 so as to be graspable by a user's fingers. In this arrangement, both the exterior cylindrical surface of supporting element 430 and the internal cylindrical wall of recess 280 are not flattened or otherwise keyed to fix their relative orientation, but are cylindrical. A key, stop or detent may, however, be provided for limiting the rotation of laser light source 400 in recess 280, e.g., to less than +60° or less than +45° or another desired limit.

The protruding forward end 430 may be for rotating either laser light source 400 or for rotating only the forward portion 430 thereof which supports cylindrical lens 440, whereby a user may conveniently change the orientation of the plane of laser light 450 relative to light housing 120 because the cylindrical lens 440, e.g., the longitudinal axis thereof, rotates with the forward portion 430. As a result the plane of laser light 450 may be rotated relative to housing 120 of portable light 100, and thus when the orientation of light 100 is not changed, the plane of laser light 450 may be rotated relative to a location wherein portable light 100 is utilized, whether portable light 100 is held by the user, attached to the user by a clip 150, or placed, e.g., with its base 130, on a surface.

Preferably, the opening in lens 144 in which laser light source 400 resides is sealed, e.g., by an O-ring, grommet, or other sealing element 145, thereby to resist the entry of moisture, dirt and debris into light 100. In addition, it is preferred that a covering lens be provided over the opening 436 in forward portion 430 of laser light source 400 when it is not covered by lens 144, thereby to resist the entry moisture, dirt and debris towards cylindrical lens 440 therein.

Figure 8B:
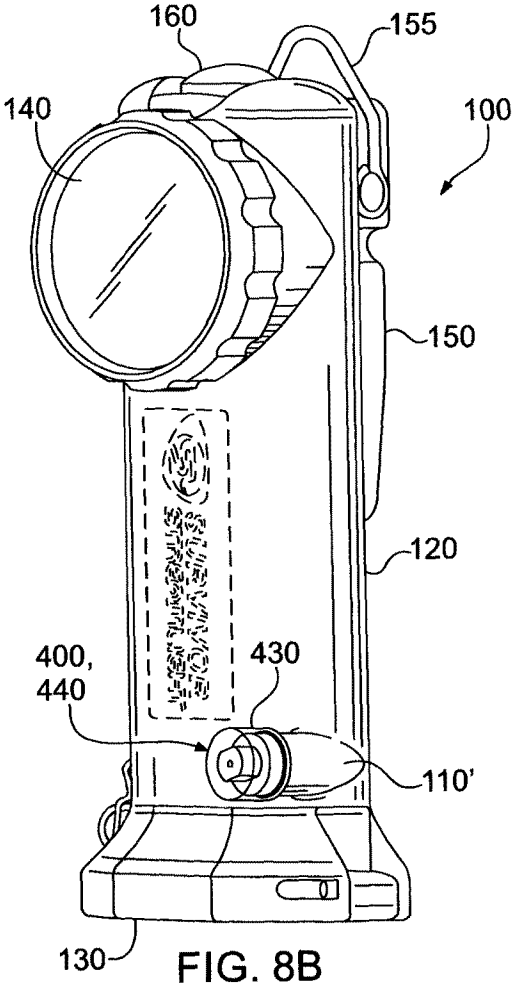
FIGS. 8A and 8B are perspective views of alternative embodiments of the portable light 100 including mounting the example laser light source on the light body thereof at locations that are spaced away from the illumination light source.
Figure 8A:
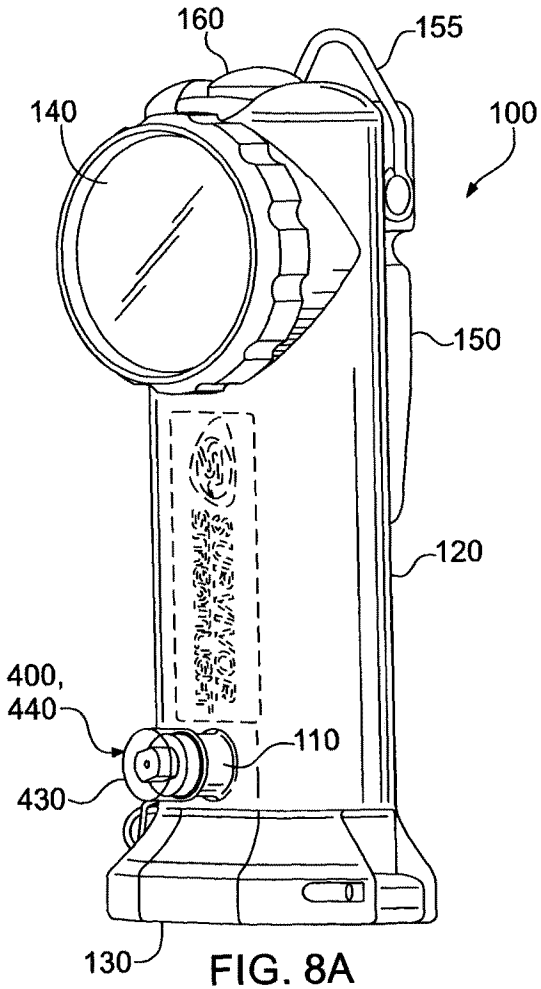

FIGS. 8A and 8B are perspective views of alternative embodiments of the portable light 100 including mounting the example laser light source 400 on the light body 120 thereof at locations that are spaced away from the illumination light source 140. Since illumination light source 140 is proximate the upper end of light housing or body 120, laser light source 400 can be at any location on housing 120 that is under illumination light source 140, i.e. closer to base 130 thereof. In general, in this embodiment, it is preferred that laser light source 400 be located away from illumination light source 140, e.g., to be close to base 130, e.g., as close as practicable.

In the illustrated embodiment of example portable light 100, the flared lower portion of housing 120 and base 130 at the bottom end thereof are configured to interface with, e.g., slide into, a standard charging device, e.g., an existing charging device that is compatible with several previous embodiments of the illustrated light (without the laser light source 400) and with several other lights that have been and/or are available. Accordingly, it is desirable to not interfere with the arrangement of that charger interface and so laser light source is preferably disposed in a receptacle 110, 110' that extends from light body 120 above the flared lower part thereof. Were that not the case, laser light source could be located closer to the bottom of light 100, e.g., at base 130.

Accordingly, laser light source 400 is preferred to be provided in a location slightly above the flared part of housing 120 as illustrated, but could be located at any desired location on light body 120 from which the plane 450 of laser light would be projected in the same general direction as is the light from illumination light source 140.

Tubular receptacle 110 may extend forwardly from the same face of light body 120 as does illumination light source 140 thereby to provide illumination light and a plane 450 of laser light in the same general direction. Laser light source 400 may be in a fixed orientation in receptacle 110 so that the orientation of plane 450 of laser light is fixed in a predetermined direction, e.g., generally parallel to the axis of light from illumination light source 140 or diverging therefrom downward towards base 130. Laser light source 400 may have its forward end extending from tubular receptacle 110 so that it may be grasped and rotated by a user, in similar manner to that described herein, to rotate the plane 450 of laser light relative to light body 120.

Alternatively, tubular receptacle 110' may extend forwardly from a side face of light body 120 thereby to provide illumination light and a plane 450 of laser light in the same general direction. Laser light source 400 may be in a fixed orientation in receptacle 110' so that the orientation of plane 450 of laser light is fixed in a predetermined direction, e.g., generally parallel to the axis of light from illumination light source 140 or diverging therefrom downward towards base 130. Laser light source 400 may have its forward end extending from tubular receptacle 110' so that it may be grasped and rotated by a user, in similar manner to that described herein, to rotate the plane 450 of laser light relative to light body 120.

Because light body 120 contains a source of electrical power, e.g., a battery, tubular receptacle 110 or 110' would project forward from body 120 so as to not interfere with the internal battery. Typically, the battery includes a number, e.g., four, of battery cells, that are preferably in a battery carrier in which the battery cells may be permanently contained or may be replaceable. The battery may be single use or may be rechargeable. Typically, for housing the same laser light source 400, receptacle 110 would project further forward from light body 120 than would tubular receptacle 110' to avoid extending into the space provided for the battery.

Typically, receptacle 110 or 110' would be integrally molded with light body 120, and the electrical wires of laser light source 400 would extend upward within light body 120, e.g., along a wall of the battery compartment therein, to connect to LED module assembly 170.

Figure 9A:
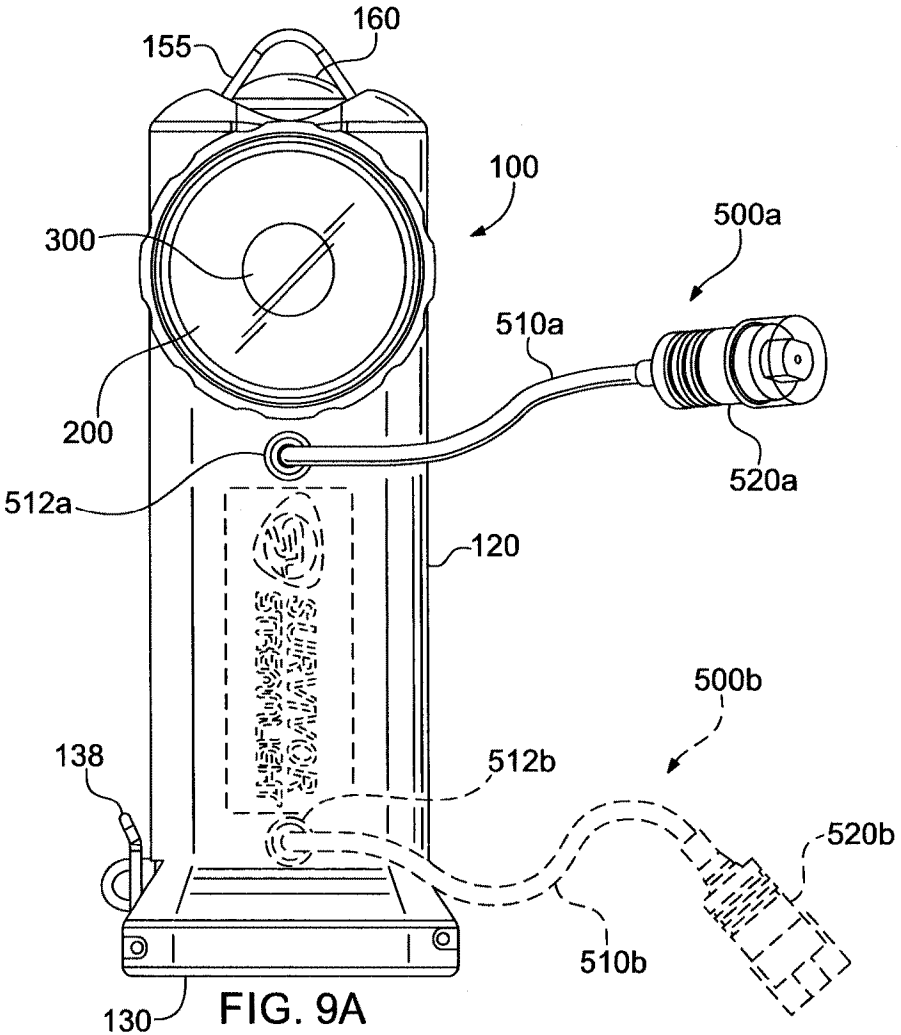
FIG. 9A is a front view of an alternative embodiment including mounting an example laser light source on a flexible stalk that is mounted to the example portable light.
Figure 9B:
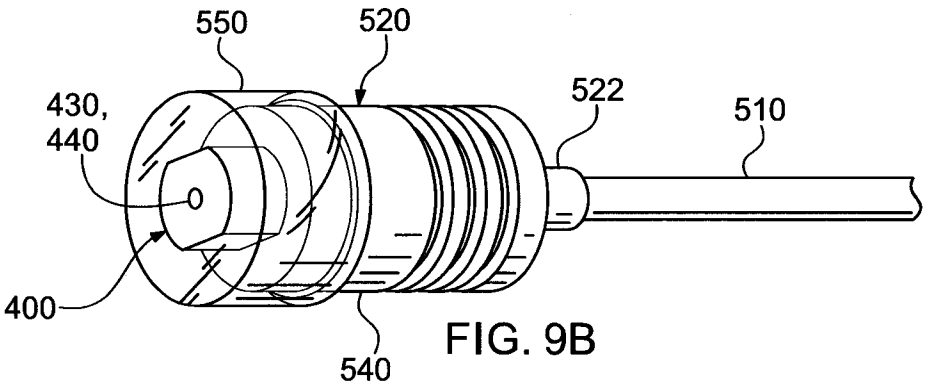
FIGS. 9B and 9C are a perspective view and a cross-sectional view, respectively, of the example laser light source mounted on the flexible stalk.
Figure 9C:
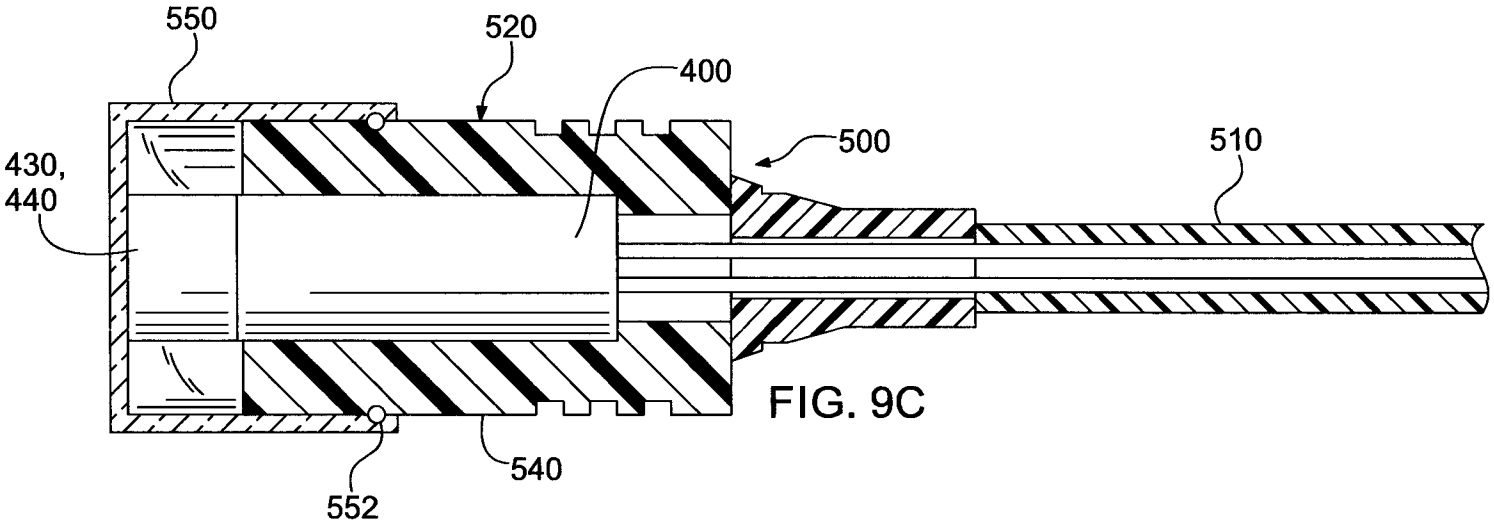

FIG. 9A is a front view of an alternative embodiment including mounting an example laser light source 400 on a flexible stalk 500 that is mounted to the example portable light 100, and FIGS. 9B and 9C are a perspective view and a cross-sectional view, respectively, of the example laser light source 400 mounted on the flexible stalk 500. Therein, laser light source 400 is mounted in a head housing 520 which is at the distal end of a flexible stalk 510 from the end thereof that is mounted to the housing or body 120 of portable light 100. For example, the flexible stalk 510 may be mounted to housing 120 at either location 502A, e.g., of attachment 512A, or at location 502B, e.g., of attachment 512B as illustrated, or alternatively may be mounted to housing 120 at any convenient location.

Flexible stalk 500 may be permanently mounted to housing 120, e.g., by a fastener or other mechanical retainer, or by adhesive, heat or ultrasonic welding, or may be mounted so as to be removable from housing 120, e.g., as by an electrical connector. The mounting of stalk 510 to housing 120 preferably includes a surrounding member 512A or 512B similar to member 522 at the distal end of stalk 510 where housing 540 of head 520 is attached thereto. Preferably the mounting of stalk 500 includes one or more seals to reduce entry of dirt, debris and/or moisture into housing 120 and head 520.

Flexible stalk 500 comprises a flexible stalk member 510 that at one end is mounted to light housing 120 and that has a head housing 520 at the other end thereof, e.g., the end distal from light housing 120, that supports laser light source 400. Flexible stalk 510 may be, e.g., a flexible tube of a helically wound metal or plastic strip and may have a thin plastic coating or sheath on the outer surface thereof. Stalk 510 has a hollow interior through which one or more electrical wires pass to connect laser light source 400 in light head 500 to the source of electrical power therefor which is disposed in housing 120.

Head housing 520 includes an outer housing 540 that preferably is permanently mounted to flexible stalk 510, e.g., as by being swaged thereto, molded thereon, or otherwise mechanically and/or adhesively attached, and housing 540 preferably has a tapered end portion surrounding the distal end of flexible stalk 510, e.g., to provide strain relief when stalk 510 is flexed, bent or formed in use to direct the light from laser light source 400 in a desired direction.

While illumination light source 140 emits illumination light in a substantially fixed predetermined direction relative to the light body 120, in all of the example embodiments the plane 450 of laser light is emitted in substantially the same predetermined direction relative to the light body 120. This is so even though the direction in which the plane 450 of laser light may be changed by flexing stalk 510. In other words, both the illumination light and the plane of laser light are emitted in the same general direction, and substantially the predetermined direction is intended to encompass such changes in direction of the laser light.

Forward end cap 550 that is of an optically transparent material so that the laser light produced by laser light source 400 passes therethrough, e.g., substantially in the direction of the longitudinal axis of light head 520. According to one embodiment, end cap 550 is affixed to housing 540 and encloses the end cap 430 of laser light source 400 which supports the cylindrical lens 440. In this embodiment, the direction and orientation of the plane 450 of laser light is changed by moving and rotating light head 520 to the extent permitted by the flexibility of stalk 510.

According to another embodiment, end cap 550 also covers and encloses the forward end of laser light source 400, however, end cap 430 that supports the cylindrical lens 440 is affixed to end cap 550 which is rotatable relative to housing 540 of light head 520. Thus, rotating end cap 550 causes the cylindrical lens 440 supported by end cap 430 to be rotated. In this embodiment, the direction and orientation of the plane 450 of laser light is changed by moving and rotating light head 520 to the extent permitted by the flexibility of stalk 510, and by rotating end cap 550 relative to housing 540, thereby to permit more freedom in the orientation of the plane 450 of laser light. Preferably, a seal 552 is provided between end cap 550 and housing 540 to reduce entry of dirt, debris and/or moisture therein.

Optionally, housing 540 and/or end cap 550 may have one or more raised or recessed features, e.g., circumferential grooves and/or ridges, that may assist gripping light head 520 and/or may be aesthetic.

In one example embodiment, laser light source 400 may include a 650 nanometer (red) 5 milliwatt laser module that is available from Sean & Stephen Corporation located in Taipei, Taiwan, R.O.C. or from Laser Max located in Taipei, Taiwan, R.O.C. The lens support 430 may be about 12 mm in diameter, about 8 mm in length, and registration feature 434 may be a flat surface about 5.25 mm radially removed from the central axis of support 430. Cylindrical lens 440 is a rod of glass or plastic, e.g., an acrylic PMMA or optical polycarbonate plastic, having a length of about 7.2 mm and a diameter of about 3.0 mm which provides a line or plane 450 of laser light typically having an angle A of about 1.5 degrees of out of plane dispersion and an angle B of about 120° of beam width. Flexible stalk 510 may be of any desired length, e.g., in one embodiment stalk 510 has a length of about 9 inches (about 23 cm), in another a length of about 3-5 inches (about 7.6-13 cm) and in a preferred embodiment stalk 510 has a length of about 1-3 inches (about 2.5-7.6 cm).

In a typical embodiment, TIR optical element 200 and lens 142 may be of an optically clear material, e.g., a glass, polycarbonate, polystyrene, PMMA (acrylic), acrylic, styrene acryl nitride (SAN), or another suitable clear plastic, glass or other suitable optical material. One example embodiment of optical element 200 is about 1.97 inches (about 50 mm) in diameter at its wide flat end, about 0.68 inch (about 17.3 mm) in diameter at its narrower end, and about 1.0 inch (about 25.4 mm) in depth front to rear. Forward cylindrical recess 250 thereof is about 0.70 inch (about 17.8 mm) in diameter and about 0.24 inch (about 6.1 mm) in depth, and rear recess 260 is about 0.67 inch (about 17 mm) in diameter and about 0.46 inch (about 11.7 mm) in depth. An example selectable beam modification element 300 therefor may be of acrylic, styrene or another suitable plastic, and is slightly less than about 0.67 inch (about 17 mm) in diameter and about 0.11 inch (about 2.8 mm) thick.

Another example embodiment of beam modification element 200 is about 1.97 inches (about 50 mm) in diameter at its wide flat end, about 0.65 inch (about 16.5 mm) in diameter at its narrower end, and about 1.0 inch (about 25.4 mm) in depth front to rear. Forward cylindrical recess 250 thereof is about 0.45 inch (about 11.4 mm) in diameter and about 0.3 inch (about 7.6 mm) in depth, and rear recess 260 is about 0.59 inch (about 15 mm) in diameter and about 0.50 inch (about 12.7 mm) in depth. An example selectable beam modification element 300 therefor may be of acrylic, styrene or another suitable plastic, and is slightly less than about 0.45 inch (about 11.4 mm) in diameter and about 0.11 inch (about 2.8 mm) thick.

In the aforementioned examples of optical element 200, side surface 240 has a shape that is a series of arches and curved bottom 270 has a domed or peaked shape as illustrated, one example being rounded and convex, almost parabolic and not quite spherical, and the other example being a curved sided peaked conical dome with concave side curvature.

One example of an LED module and heat sink of the sort suitable for use in light 100 and similar to that described herein is described in U.S. Pat. No. 7,883,243 issued Feb. 8, 2011 and entitled "LED FLASHLIGHT AND HEAT SINK ARRANGEMENT" which is assigned to Streamlight, Inc. of Eagleville, Pa., which is hereby incorporated herein by reference in its entirety.

A portable light 100 may comprise: a light body 120 for receiving a source of electrical power; a white light source 140 supported by the light body 120 and selectively energizable for producing white light; a laser light source 400 supported by the light body 120 and selectively energizable for producing laser light, wherein the laser light source 400 may include a cylindrical lens 440 configured for receiving light from a laser emission element and for transmitting the received light as a plane of laser light 450, whereby the laser light source 400 is configured to emit a plane of laser light 450; and a switch 160 supported by the light body 120 for selectively energizing the white light source 140 from the source of electrical power, and for selectively energizing the laser light source 400 from the source of electrical power. The laser emission element may comprise a laser diode. The laser light source 400 may include a registration feature on an external surface thereof disposed in registration with a longitudinal axis of the cylindrical lens 440. The registration feature may have an axis oriented perpendicular to the longitudinal axis of the cylindrical lens 440. The white light source 140 may include a shaped optically clear plastic element having a polished curved external side surface and a generally wider flat forward surface oriented such that the white light exits the white light source 140 through the flat forward surface, and wherein the laser light source 400 is supported by the flat forward surface. The switch 160 may be operable so that only one of the white light source 140 and the laser light source 400 is active at a given time. The white light source 140 and the laser light source 400 may emit light in substantially the same direction. The laser light source 400 may be configured: for rotating the plane of laser light 450 relative to the light body 120; or for repositioning the plane of laser light 450 relative to the light body 120. The laser light source 400 may be supported by a shaped optical element 200 of the white light source 140 or may be supported by a receptacle of the light body 120 or may be supported at a distal end of a flexible stalk 500, 510 supported by the light body 120. The laser light source 400 may be configured: for rotating the plane of laser light 450 relative to the light body 120; or for repositioning the plane of laser light 450 relative to the light body 120.

A portable light 100 may comprise: a light body 120 for receiving a source of electrical power; an illumination light source 140 supported by the light body 120 and selectively energizable for producing illumination light; a laser light source 400 supported by the light body 120 and selectively energizable for producing laser light, wherein the laser light source 400 may include a cylindrical lens 440 configured for receiving light from a laser emission element and for transmitting the received light as a plane of laser light 450, whereby the laser light source 400 is configured to emit a plane of laser light 450; and a switch 160 supported by the light body 120 for selectively energizing the illumination light source 140 from the source of electrical power and for selectively energizing the laser light source 400 from the source of electrical power. The laser emission element may comprise a laser diode. The laser light source 400 may include a registration feature on an external surface thereof disposed in registration with a longitudinal axis of the cylindrical lens 440. The registration feature may have an axis oriented perpendicular to the longitudinal axis of the cylindrical lens 440. The illumination light source 140 may include a shaped optically clear element 200 having a polished curved external side surface and a generally wider flat forward surface whereat the illumination light exits the illumination light source 140 through the flat forward surface, and wherein the laser light source 400 is supported by the shaped optically clear element 200. The switch 160 may be operable so that only one of the illumination light source 140 and laser light source 400 is energized at a given time. The illumination light source 140 and the laser light source 400 may emit light in substantially the same direction. The laser light source 400 may be configured: for rotating the plane of laser light 450 relative to the light body 120; or for repositioning the plane of laser light 450 relative to the light body 120. The laser light source 400 may be supported by a shaped optical element 200 of the illumination light source 140 or may be supported by a receptacle of the light body 120 or may be supported at a distal end of a flexible stalk 500, 510 supported by the light body 120. The laser light source 400 may be configured: for rotating the plane of laser light 450 relative to the light body 120; or for repositioning the plane of laser light 450 relative to the light body 120. The laser light source 400: may be supported by a reflective element of the illumination light source 140 and may be rotatable relative thereto; or may be supported by a receptacle of the light body 120 and may be rotatable relative thereto; or may be supported on a flexible stalk 500, 510 that is attached to the light body 120. The laser light source 400 may further include a support for the cylindrical lens 440, wherein: the support for the cylindrical lens 440 is rotatable relative to the light body 120, whereby a longitudinal axis of the cylindrical lens 440 is rotatable relative to the light body 120; or the laser emission element and the support for the cylindrical lens 440 are supported on a flexible stalk 500, 510 that is attached to the light body 120, whereby a longitudinal axis of the cylindrical lens 440 is repositionable relative to the light body 120; or the laser emission element and the support for the cylindrical lens 440 are supported on a flexible stalk 500, 510 that is attached to the light body 120 and the support for the cylindrical lens 440 is rotatable relative to the flexible stalk 500, 510, whereby a longitudinal axis of the cylindrical lens 440 is rotatable and repositionable relative to the light body 120.

A portable light 100 may comprise: a light body 120 for receiving a source of electrical power and having a base end; an illumination light source 140 supported by the light body 120 relatively nearer to an end thereof that is remote to the base end thereof, the illumination light source 140 being configured to emit illumination light in a predetermined direction relative to the light body 120 and being selectively energizable for producing illumination light; a laser light source 400 supported by the light body 120 relatively nearer to the base end thereof than is the illumination light source and being selectively energizable for producing laser light, wherein the laser light source 400 includes a cylindrical lens 440 configured for receiving laser light from a laser emission element and for transmitting the received laser light as a plane 450 of laser light in substantially the predetermined direction relative to the light body 120, whereby the laser light source 440 is configured to emit a plane 450 of laser light in the same general direction as the illumination light is emitted; and a switch 160 supported by the light body 120 for selectively energizing the illumination light source 140 from the source of electrical power and for selectively energizing the laser light source 400 from the source of electrical power. The laser light source 400 may be: supported in a fixed location that is relatively nearer to the base end of the light body 120 than is the illumination light source 140; or supported on a flexible stalk 510 that is relatively nearer to the base end 130 of the light body 120 than is the illumination light source 140. The laser light source 400 may further include a support for the cylindrical lens 440, wherein: the support for the cylindrical lens 440 is rotatable relative to the light body 120, whereby a longitudinal axis of the cylindrical lens 440 is rotatable relative to the light body 120; or the laser emission element and the support for the cylindrical lens 440 are supported on a flexible stalk 500, 510 that is attached to the light body 120, whereby a longitudinal axis of the cylindrical lens 440 is repositionable relative to the light body 120; or the laser emission element and the support for the cylindrical lens 440 are supported on a flexible stalk 500, 510 that is attached to the light body 120 and the support for the cylindrical lens 440 is rotatable relative to the flexible stalk 500, 510, whereby a longitudinal axis of the cylindrical lens 440 is rotatable and repositionable relative to the light body 120. The switch 160 is operable so that only one of the illumination light source 140 and laser light source 400 is energized at a given time.

A portable light 100 may comprise: a light body 120 for receiving a source of electrical power; an illumination light source 140 supported by the light body 120 and selectively energizable for producing illumination light, wherein the illumination light source 140 includes a shaped optically clear element 200 having a polished curved external side surface and a flat forward surface through which the illumination light exits the illumination light source 140 in a predetermined direction relative to the light body 120; a laser light source 400 supported by the shaped optically clear element 200 and selectively energizable for producing laser light, wherein the laser light source 400 includes a cylindrical lens 440 configured for receiving light from a laser emission element and for transmitting the received light as a plane 450 of laser light; and a switch 160 supported by the light body 120 for selectively energizing the illumination light source 140 from the source of electrical power and for selectively energizing the laser light source 400 from the source of electrical power. The plane 450 of laser light may be emitted substantially in the predetermined direction relative to the light body 120, whereby the laser light source 400 is configured to emit a plane 450 of laser light in the same general direction as the illumination light is emitted. The laser light source 400 may further include a support 430 for the cylindrical lens 440 that is rotatable relative to the light body 120, whereby a longitudinal axis of the cylindrical lens 440 and the plane 450 of laser light transmitted thereby are rotatable relative to the light body 120. The switch 160 may be operable so that only one of the illumination light source 140 and the laser light source 400 is energized at a given time.

A portable light 100 may comprise: a light body 120 for receiving a source of electrical power; an illumination, e.g., white, light source 140, 176 supported by the light body 120 and selectively energizable for producing light; a laser light source 400 supported by said light body 120 and selectively energizable for producing laser light, the laser light source configured to emit a plane of laser light 450; a switch 160, 172 supported by the light body 120 for selectively energizing the white light source 140, 176 from the source of electrical power; a TIR optical element 200 having a rearward end disposed in front of the white light source 140, 176 for receiving the light produced thereby, the TIR optical element 200 employing total internal reflection to form light produced by the white light source 140, 176 into a collimated beam of light, the TIR optical element 200 having a recess 250 in a forward face thereof; a selectable beam modification element 300 having a size and shape corresponding to the recess 250 in the forward face of the TIR optical element 200, wherein the selectable beam modification element 300 is placeable into the recess 250 in the forward face of the TIR optical element 200 and is removable from the recess 250 in the forward face of the TIR optical element 200; and means for removably retaining the selectable beam modification element 300 in the recess 250 in the forward face of the TIR optical element 200. The means for removably retaining may include: friction between the selectable beam modification element 300 and the recess 250, pressure urging the selectable beam modification element 300 into the recess 250, a cover, a lens, a lens and ring, a press in cover, a snap in cover, the selectable beam modification element 300 having a resilient periphery, the selectable beam modification element 300 being of a resilient material, the selectable beam modification element 300 having a diameter to contact the inner surface of the recess 250 in the TIR optical element 200, the selectable beam modification element 300 having an O-ring in a peripheral groove, or a combination thereof. The selectable beam modification element 300 may be opaque, or transparent, or translucent, or a color, or a combination thereof. The TIR optical element 200 may comprise: a shaped optically clear plastic element 210 having a polished curved external side surface 240, a generally wider flat forward surface 220, and a narrower rearward shaped surface 230, 260, 270. The TIR optical element 200 may have: a substantially cylindrical recess 260 at the rearward shaped surface thereof, the substantially cylindrical recess 260 having a curved convex bottom or a peaked conical bottom having concave sides for reflecting light through a side wall of the cylindrical recess 260; or a cylindrical recess 250 in the flat forward face thereof having a textured surface at the bottom thereof; or a substantially cylindrical recess 260 at the rearward shaped surface thereof, the substantially cylindrical recess 260 having a curved convex bottom or a peaked conical bottom having concave sides for reflecting light through a side wall of the cylindrical recess 260, and a cylindrical recess 250 in the flat forward face thereof having a textured surface at the bottom thereof. The portable light 100 wherein: the curved external side surface of the TIR optical element 200 is substantially parabolic; or the narrower rearward surface of the TIR optical element 200 includes a convex parabolic surface; or the curved external side surface of the TIR optical element 200 is substantially parabolic and the narrower rearward surface of the TIR optical element 200 includes a convex parabolic surface or a peaked conical surface having concave sides. The selectable beam modification element 300 includes a plurality of selectable beam modification elements 300, at least one of the plurality of selectable beam modification elements 300 being opaque and at least one of the plurality of selectable beam modification elements 300 being transparent or translucent and being colored. The selectable beam modification element 300 includes a set of a plurality of selectable beam modification elements 300, each of the selectable beam modification elements 300 having an optical property that is different from an optical property of another of the selectable beam modification elements 300.

A portable light 100 may comprise: a light body 120; a white light source 140, 176 selectively energizable for producing light; a laser light source 400 supported by said light body 120 and selectively energizable for producing laser light, the laser light source configured to emit a plane of laser light 450; a switch 160, 172 for selectively energizing the white light source 140, 176; a TIR optical element 200 disposed in front of the white light source 140, 176 for receiving the light produced thereby, and to form the light produced thereby into a collimated beam of light, the TIR optical element having a recess 250 in a forward face thereof; and a selectable beam modification element 300 placeable into and removable from the recess 250 in the forward face of the TIR optical element. The means for removably retaining may include: friction between the selectable beam modification element 300 and the recess 250, pressure urging the selectable beam modification element 300 into the recess 250, a cover, a lens, a lens and ring, a press in cover, a snap in cover, the selectable beam modification element 300 having a resilient periphery, the selectable beam modification element 300 being of a resilient material, the selectable beam modification element 300 having a diameter to contact the inner surface of the recess 250 in the TIR optical element 200, the selectable beam modification element 300 having an O-ring in a peripheral groove, or a combination thereof. The selectable beam modification element 300 may be opaque, or transparent, or translucent, or a color, or a combination thereof. The TIR optical element 200 may comprise: a shaped optically clear plastic element 210 having a polished curved external side surface 240, a generally wider flat forward surface 220, and a narrower rearward shaped surface 230, 260, 270. The TIR optical element 200 may have: a substantially cylindrical recess 260 at the rearward shaped surface thereof, the substantially cylindrical recess 260 having a curved convex bottom or a peaked conical bottom having concave sides for reflecting light through a side wall of the cylindrical recess 260; or a cylindrical recess 250 in the flat forward face thereof having a textured surface at the bottom thereof; or a substantially cylindrical recess 260 at the rearward shaped surface thereof, the substantially cylindrical recess 260 having a curved convex bottom or a peaked conical bottom having concave sides for reflecting light through a side wall of the cylindrical recess 260, and a cylindrical recess 250 in the flat forward face thereof having a textured surface at the bottom thereof. The portable light 100 wherein: the curved external side surface of the TIR optical element 200 is substantially parabolic; or the narrower rearward surface of the TIR optical element 200 includes a convex parabolic surface; or the curved external side surface of the TIR optical element 200 is substantially parabolic and the narrower rearward surface of the TIR optical element 200 includes a convex parabolic surface or a peaked conical surface having concave sides. The selectable beam modification element 300 includes a plurality of selectable beam modification elements 300, at least one of the plurality of selectable beam modification elements 300 being opaque and at least one of the plurality of selectable beam modification elements 300 being transparent or translucent and being colored. The selectable beam modification element 300 includes a set of a plurality of selectable beam modification elements 300, each of the selectable beam modification elements 300 having an optical property that is different from an optical property of another of the selectable beam modification elements 300.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "up," "down," "front," "rear," "side," "end," "top," "bottom," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

As used herein, the term "and/or" encompasses both the conjunctive and the disjunctive cases, so that a phrase in the form "A and/or B" encompasses "A" or "B" or "A and B." In addition, the term "at least one of" one or more elements is intended to include one of any one of the elements, more than one of any of the elements, and two or more of the elements up to and including all of the elements, and so, e.g., the phrase in the form "at least one of A, B and C" includes "A," "B," "C," "A and B," "A and C," "B and C," and "A and B and C."

The term battery is used herein to refer to an electro-chemical device comprising one or more electro-chemical cells and/or fuel cells, and so a battery may include a single cell or plural cells, whether as individual units or as a packaged unit. A battery is one example of a type of an electrical power source suitable for a portable device. Other devices could include fuel cells, super capacitors, solar cells, and the like. Any of the foregoing may be intended for a single use or for being rechargeable or for both Various embodiments of a battery may have one or more battery cells, e.g., one, two, three, four, or five or more battery cells, as may be deemed suitable for any particular device. A battery may employ various types and kinds of battery chemistry types, e.g., a carbon-zinc, alkaline, lead acid, nickel-cadmium (Ni—Cd), nickel-metal-hydride (NIMH) or lithium-ion (Li-Ion) battery type, of a suitable number of cells and cell capacity for providing a desired operating time and/or lifetime for a particular device, and may be intended for a single use or for being rechargeable or for both. Examples may include a four cell lead acid battery typically producing about 6 volts, volts, a four cell Ni—Cd battery typically producing about 6 volts, a four cell NiMH battery typically producing about 4.8 volts, a four cell NiMH battery producing about 6 volts, or a Li-Ion battery typically producing about the same voltage, it being noted that the voltages produced thereby will be higher when approaching full charge and will be lower in discharge, particularly when providing higher current and when reaching a low level of charge, e.g., becoming discharged.

The term DC converter is used herein to refer to any electronic circuit that receives at an input electrical power at one voltage and current level and provides at an output DC electrical power at a different voltage and/or current level. Examples may include a DC-DC converter, an AC-DC converter, a boost converter, a buck converter, a buck-boost converter, a single-ended primary-inductor converter (SEPIC), a series regulating element, a current level regulator, and the like. The input and output thereof may be DC coupled and/or AC coupled, e.g., as by a transformer and/or capacitor. A DC converter may or may not include circuitry for regulating a voltage and/or a current level, e.g., at an output thereof, and may have one or more outputs providing electrical power at different voltage and/or current levels and/or in different forms, e.g., AC or DC.

A fastener as used herein may include any fastener or other fastening device that may be suitable for the described use, including threaded fasteners, e.g., bolts, screws and driven fasteners, as well as pins, rivets, nails, spikes, barbed fasteners, clips, clamps, nuts, speed nuts, cap nuts, acorn nuts, and the like. Where it is apparent that a fastener would be removable in the usual use of the example embodiment described herein, then removable fasteners would be preferred in such instances. A fastener may also include, where appropriate, other forms of fastening such as a formed head, e.g., a peened or heat formed head, a weld, e.g., a heat weld or ultrasonic weld, a braze, and adhesive, and the like.

As used herein, the terms "connected" and "coupled" as well as variations thereof are not intended to be exact synonyms, but to encompass some similar things and some different things. The term "connected" may be used generally to refer to elements that have a direct electrical and/or physical contact to each other, whereas the term "coupled" may be used generally to refer to elements that have an indirect electrical and/or physical contact with each other, e.g., via one or more intermediate elements, so as to cooperate and/or interact with each other, and may include elements in direct contact as well.

While the present invention has been described in terms of the foregoing example embodiments, variations within the scope and spirit of the present invention as defined by the claims following will be apparent to those skilled in the art. For example, the laser light source 400 may be configured so that the plane of laser light 450 is substantially parallel to the central axis of the optical element 200 or may be configured so that the plane of laser light 450 diverges from the central axis of the optical element 200 (and from the beam of illumination light, e.g., white light, provided thereby).

The laser light source 400 and/or the cylindrical lens 440 thereof may be configured to be in a predetermined fixed relationship relative to light 100 and optical element 200 thereof, or may be configured to be rotatable with respect to light 100, whereby the orientation of the plane of laser light 450 rotatable. Rotating the plane of laser light 450 relative to light 100 may be provided by optical element 200 being rotatable in light 100, by laser light source 400 being rotatable in optical element 200, or by the longitudinal axis of cylindrical lens 440 being rotatable relative to light 100, or by a combination thereof. In any of the foregoing arrangements, rotation of the one or more elements my be provided by an actuator accessible from outside light 100, e.g., by a rotatable ring, by a lever, by a slidable actuator and the like.

Further, and alternatively, laser light source 400 may be supported in the central region of optical element 200, e.g., within recess 250 thereof. In such alternative arrangement, beam modification element 300 could have a central hole therein so as to be inserted into recess 250 to surround laser light source 400, or could be a permanently installed part of optical element 200, e.g., as a opaque or translucent annular washer in recess 250 thereof. In this alternative arrangement, when laser light source 400 is configured such that the plane 450 of laser light is rotatable, the opening in lens 144 through which laser light source 400 extends would be centrally located which would ease the mounting and removal of lens ring 142 and lens 144, e.g., when installing or removing beam modification element 300.

While a red emitting laser light source 400 is described in an example embodiment, the light produced by the laser light source 400 may be at another wavelength, e.g., at a wavelength of red, or blue, or green, or amber, light. Further, the color of the laser light may be changeable from one color to another, either by replacing a laser light source 400 with a laser light source of another color light, or by providing one or more laser light sources 400 that can be electronically controlled to produce laser light of different colors, e.g., at different wavelengths.

Actuator 160 may be configured to actuate illumination light source 140 and laser light source 400 together, e.g., toggling between both on and both off, or independently, e.g., in a sequential order such as white light, laser light, and white and laser light together, or by being responsive to how actuator 160 is actuated, e.g., by a single actuation, by plural actuations close in time, by an actuation continuing for an extended time, and the like. Alternatively, actuator 160 may include physically separate actuators, e.g., one for illumination light source 140 and another for laser light source 400.

Alternatively, a separate actuator and switch may be provided for laser light source 400, e.g., proximate to or on receptacle 110, 110' therefor and/or proximate to or on head 520 at the end of flexible stalk 510. Flexible stalk 510 may be made relatively short, e.g., about 1-2 inches (about 2.5-5 cm), which is sufficient to provide limited user adjustable directionality to the plane of laser light, or it may be relatively longer, e.g., about 8-10 inches (about 20-25 cm), where greater user adjustability is desired, or any intermediate length.

In optical element 200, side surface 240 may have a parabolic, hyperbolic or spherical shape and curved bottom 270 may have the same or a different parabolic, hyperbolic or spherical shape, or surfaces 240, 270 may have another suitable shape.

Hanger or loop 155 may alternatively be rendered pivotable by the ends thereof being disposed in holes in clip 150 or in housing 120, or by the ends or a portion thereof being directly and pivotably attached to housing 120, e.g., by bracket 152.

While certain features may be described as a raised feature, e.g., a ridge, boss, flange, projection or other raised feature, such feature may be positively formed or may be what remains after a recessed feature, e.g., a groove, slot, hole, indentation, recess or other recessed feature, is made. Similarly, while certain features may be described as a recessed feature, e.g., a groove, slot, hole, indentation, recess or other recessed feature, such feature may be positively formed or may be what remains after a raised feature, e.g., a ridge, boss, flange, projection or other raised feature, is made.

Each of the U.S. Provisional applications, U.S. patent applications, and/or U.S. patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light comprising:

a light body for receiving a source of electrical power;

a white light source supported by said light body and selectively energizable for producing white light;

a laser light source supported by said light body and selectively energizable for producing laser light, wherein said laser light source includes a cylindrical lens configured for receiving light from a laser emission element and for transmitting the received light as a plane of laser light, the cylindrical lens receiving laser light at a first part of a cylindrical surface thereof and emitting the plane of laser light from a second part of that cylindrical surface, whereby the laser light source is configured to emit a plane of laser light; and a switch supported by said light body for selectively energizing said white light source from the source of electrical power, and for selectively energizing said laser light source from the source of electrical power.

2. The portable light of claim 1 wherein the laser emission element comprises a laser diode.

3. The portable light of claim 1 wherein said laser light source includes a registration feature on an external surface thereof disposed in registration with a longitudinal axis of the cylindrical lens.

4. The portable light of claim 3 wherein the registration feature has an axis oriented perpendicular to the longitudinal axis of the cylindrical lens.

5. The portable light of claim 1 wherein said switch is operable so that only one of said white light source and said laser light source is active at a given time.

6. The portable light of claim 1 wherein said white light source and said laser light source emit light in substantially the same direction.

7. The portable light of claim 1 wherein said laser light source is configured:

for rotating the plane of laser light relative to said light body; or for repositioning the plane of laser light relative to said light body.

8. The portable light of claim 1 wherein said laser light source is supported by a shaped optical element of said white light source or is supported by a receptacle of said light body or is supported at a distal end of a flexible stalk supported by said light body.

9. The portable light of claim 8 wherein said laser light source is configured:

for rotating the plane of laser light relative to said light body; or for repositioning the plane of laser light relative to said light body.

10. A portable light comprising:

a light body for receiving a source of electrical power;

a white light source supported by said light body and selectively energizable for producing white light;

a laser light source supported by said light body and selectively energizable for producing laser light, wherein said laser light source includes a cylindrical lens configured for receiving light from a laser emission element and for transmitting the received light as a plane of laser light, whereby the laser light source is configured to emit a plane of laser light; and a switch supported by said light body for selectively energizing said white light source from the source of electrical power, and for selectively energizing said laser light source from the source of electrical power; and wherein said white light source includes a shaped optically clear plastic element having a polished curved external side surface and a generally wider flat forward surface oriented such that the white light exits the white light source through the flat forward surface, and wherein the laser light source is supported by the flat forward surface.

11. A portable light comprising:

a light body for receiving a source of electrical power;

an illumination light source supported by said light body and selectively energizable for producing illumination light;

a laser light source supported by said light body and selectively energizable for producing laser light, wherein said laser light source includes a cylindrical lens configured for receiving light from a laser emission element and for transmitting the received light as a plane of laser light, the cylindrical lens receiving laser light at a first part of a cylindrical surface thereof and emitting the plane of laser light from a second part of that cylindrical surface, whereby the laser light source is configured to emit a plane of laser light; and a switch supported by said light body for selectively energizing said illumination light source from the source of electrical power and for selectively energizing said laser light source from the source of electrical power.

12. The portable light of claim 11 wherein the laser emission element comprises a laser diode.

13. The portable light of claim 11 wherein said laser light source includes a registration feature on an external surface thereof disposed in registration with a longitudinal axis of the cylindrical lens.

14. The portable light of claim 13 wherein the registration feature has an axis oriented perpendicular to the longitudinal axis of the cylindrical lens.

15. The portable light of claim 11 wherein said switch is operable so that only one of the illumination light source and laser light source is energized at a given time.

16. The portable light of claim 11 wherein said illumination light source and said laser light source emit light in substantially the same direction.

17. The portable light of claim 11 wherein said laser light source is configured:

for rotating the plane of laser light relative to said light body; or for repositioning the plane of laser light relative to said light body.

18. The portable light of claim 11 wherein said laser light source is supported by a shaped optical element of said illumination light source or is supported by a receptacle of said light body or is supported at a distal end of a flexible stalk supported by said light body.

19. The portable light of claim 18 wherein said laser light source is configured:

for rotating the plane of laser light relative to said light body; or for repositioning the plane of laser light relative to said light body.

20. The portable light of claim 19 wherein said laser light source:

is supported by a reflective element of said illumination light source and is rotatable relative thereto; or is supported by a receptacle of said light body and is rotatable relative thereto; or is supported on a flexible stalk that is attached to said light body.

21. The portable light of claim 11 wherein said laser light source further includes a support for said cylindrical lens, wherein:

the support for said cylindrical lens is rotatable relative to said light body, whereby a longitudinal axis of said cylindrical lens is rotatable relative to said light body; or the laser emission element and the support for said cylindrical lens are supported on a flexible stalk that is attached to said light body, whereby a longitudinal axis of said cylindrical lens is repositionable relative to said light body; or the laser emission element and the support for said cylindrical lens are supported on a flexible stalk that is attached to said light body and said support for said cylindrical lens is rotatable relative to said flexible stalk, whereby a longitudinal axis of said cylindrical lens is rotatable and repositionable relative to said light body.

22. A portable light comprising:

a light body for receiving a source of electrical power;

an illumination light source supported by said light body and selectively energizable for producing illumination light;

a laser light source supported by said light body and selectively energizable for producing laser light, wherein said laser light source includes a cylindrical lens configured for receiving light from a laser emission element and for transmitting the received light as a plane of laser light, whereby the laser light source is configured to emit a plane of laser light; and a switch supported by said light body for selectively energizing said illumination light source from the source of electrical power and for selectively energizing said laser light source from the source of electrical power; and wherein said illumination light source includes a shaped optically clear element having a polished curved external side surface and a generally wider flat forward surface whereat the illumination light exits said illumination light source through the flat forward surface, and wherein said laser light source is supported by said shaped optically clear element.

23. A portable light comprising:

a light body for receiving a source of electrical power and having a base end;

an illumination light source supported by said light body relatively nearer to an end thereof that is remote to the base end thereof, said illumination light source being configured to emit illumination light in a predetermined direction relative to said light body and being selectively energizable for producing illumination light;

a laser light source supported by said light body relatively nearer to the base end thereof than is said illumination light source and being selectively energizable for producing laser light, wherein said laser light source includes a cylindrical lens configured for receiving laser light from a laser emission element and for transmitting the received laser light as a plane of laser light in substantially the predetermined direction relative to said light body, the cylindrical lens receiving laser light at a first part of a cylindrical surface thereof and emitting the plane of laser light from a second part of that cylindrical surface, whereby the laser light source is configured to emit a plane of laser light in the same general direction as the illumination light is emitted; and a switch supported by said light body for selectively energizing said illumination light source from the source of electrical power and for selectively energizing said laser light source from the source of electrical power.

24. The portable light of claim 23 wherein said laser light source is:

supported in a fixed location that is relatively nearer to the base end of said light body than is said illumination light source; or supported on a flexible stalk that is relatively nearer to the base end of said light body than is said illumination light source.

25. The portable light of claim 23 wherein said switch is operable so that only one of the illumination light source and laser light source is energized at a given time.

26. A portable light comprising:

a light body for receiving a source of electrical power and having a base end;

an illumination light source supported by said light body relatively nearer to an end thereof that is remote to the base end thereof, said illumination light source being configured to emit illumination light in a predetermined direction relative to said light body and being selectively energizable for producing illumination light;

a laser light source supported by said light body relatively nearer to the base end thereof than is said illumination light source and being selectively energizable for producing laser light, wherein said laser light source includes a cylindrical lens configured for receiving laser light from a laser emission element and for transmitting the received laser light as a plane of laser light in substantially the predetermined direction relative to said light body, whereby the laser light source is configured to emit a plane of laser light in the same general direction as the illumination light is emitted; and a switch supported by said light body for selectively energizing said illumination light source from the source of electrical power and for selectively energizing said laser light source from the source of electrical power; and wherein said laser light source further includes a support for said cylindrical lens, wherein:

the support for said cylindrical lens is rotatable relative to said light body, whereby a longitudinal axis of said cylindrical lens is rotatable relative to said light body; or the laser emission element and the support for said cylindrical lens are supported on a flexible stalk that is attached to said light body, whereby a longitudinal axis of said cylindrical lens is repositionable relative to said light body; or the laser emission element and the support for said cylindrical lens are supported on a flexible stalk that is attached to said light body and said support for said cylindrical lens is rotatable relative to said flexible stalk, whereby a longitudinal axis of said cylindrical lens is rotatable and repositionable relative to said light body.

27. A portable light comprising:

a light body for receiving a source of electrical power;

an illumination light source supported by said light body and selectively energizable for producing illumination light, wherein said illumination light source includes a shaped optically clear element having a polished curved external side surface and a flat forward surface through which the illumination light exits said illumination light source in a predetermined direction relative to said light body;

a laser light source supported by said shaped optically clear element and selectively energizable for producing laser light, wherein said laser light source includes a cylindrical lens configured for receiving light from a laser emission element and for transmitting the received light as a plane of laser light; and a switch supported by said light body for selectively energizing said illumination light source from the source of electrical power and for selectively energizing said laser light source from the source of electrical power.

28. The portable light of claim 27 wherein the plane of laser light is emitted substantially in the predetermined direction relative to said light body, whereby the laser light source is configured to emit a plane of laser light in the same general direction as the illumination light is emitted.

29. The portable light of claim 27 wherein said laser light source further includes a support for said cylindrical lens that is rotatable relative to said light body, whereby a longitudinal axis of said cylindrical lens and the plane of laser light transmitted thereby are rotatable relative to said light body.

30. The portable light of claim 27 wherein said switch is operable so that only one of said illumination light source and said laser light source is energized at a given time.

31. A portable light comprising:

a light body for receiving a source of electrical power;

an illumination light source supported by said light body and selectively energizable for producing illumination light, wherein said illumination light source includes a shaped optically clear element having a curved external side surface and a forward surface through which the illumination light exits said illumination light source in a predetermined direction relative to said light body;

a laser light source supported by said shaped optically clear element and selectively energizable for producing laser light, wherein said laser light source includes a cylindrical lens configured for receiving light from a laser emission element and for transmitting the received light as a plane of laser light; and a switch supported by said light body for selectively energizing said illumination light source from the source of electrical power and for selectively energizing said laser light source from the source of electrical power.

* * * * *